US009062502B2

(12) United States Patent
King

(10) Patent No.: US 9,062,502 B2
(45) Date of Patent: Jun. 23, 2015

(54) PDC DISC CUTTERS AND ROTARY DRILL BITS UTILIZING PDC DISC CUTTERS

(75) Inventor: William W. King, Houston, TX (US)

(73) Assignee: Varel International Ind., L.P., Carrollton, TX (US)

( * ) Notice: Subject to any disclaimer, the term of this patent is extended or adjusted under 35 U.S.C. 154(b) by 297 days.

(21) Appl. No.: 13/548,449

(22) Filed: Jul. 13, 2012

(65) Prior Publication Data

US 2013/0014999 A1 Jan. 17, 2013

Related U.S. Application Data

(60) Provisional application No. 61/507,503, filed on Jul. 13, 2011.

(51) Int. Cl.
*E21B 10/58* (2006.01)
*E21B 10/12* (2006.01)
*E21B 10/52* (2006.01)

(52) U.S. Cl.
CPC ..... *E21B 10/12* (2013.01); *E21B 10/52* (2013.01)

(58) Field of Classification Search
CPC ..... E21B 10/32; E21B 10/42; E21B 10/55; E21B 10/58
USPC ..... 175/426, 427, 434, 435, 373, 351, 352, 175/382, 384, 391; 76/108.1, 108.4
See application file for complete search history.

(56) References Cited

U.S. PATENT DOCUMENTS 1,122,787 A * 12/1914 Moore ..... 76/108.1
2,889,138 A 6/1959 Haglund
3,981,370 A * 9/1976 Bingham et al. ..... 175/373
4,690,691 A * 9/1987 Komanduri ..... 51/293
4,830,123 A * 5/1989 Daly et al. ..... 175/431
5,103,922 A * 4/1992 Jones ..... 175/429
5,201,376 A 4/1993 Williams
5,232,320 A * 8/1993 Tank et al. ..... 408/145
5,626,201 A * 5/1997 Friant et al. ..... 175/365
5,706,906 A 1/1998 Jurewicz et al.
6,241,036 B1 * 6/2001 Lovato et al. ..... 175/432
6,454,024 B1 * 9/2002 Nackerud ..... 175/57
6,460,631 B2 10/2002 Dykstra et al.
6,691,803 B2 * 2/2004 Nackerud ..... 175/57

(Continued)

OTHER PUBLICATIONS

Copenheaver, Blaine R, International Search Report and Written Opinion of the International Searching Authority for PCT/US2012/046628, Oct. 5, 2012, pp. 1-17.

*Primary Examiner* — Kenneth L Thompson
(74) *Attorney, Agent, or Firm* — King & Spalding LLP

(57) ABSTRACT

A disc cutter and a downhole tool including disc cutters therein. The disc cutter is disc-shaped and includes a lower portion and an upper portion. The lower portion is fabricated using a substrate material. At least a portion of the upper portion's perimeter is fabricated using at least one of polycrystalline diamond, synthetic diamond grit, natural diamond grit, and cubic boron nitride. According to certain exemplary embodiments, the disc cutter also includes an intermediate layer, which is fabricated from the substrate material, extending outwardly from at least a portion of the lower portion to a distal end positioned within the upper portion. In alternative exemplary embodiments, the disc cutter is disc-shaped and includes an inner portion made of substrate material, an outer portion made of at least one of polycrystalline diamond, synthetic diamond grit, natural diamond grit, and cubic boron nitride, and a channel extending orthogonally through the inner portion.

31 Claims, 9 Drawing Sheets

(56) References Cited

U.S. PATENT DOCUMENTS

| | | | | |
|---|---|---|---|---|
| 6,695,074 | B2 * | 2/2004 | Nackerud | 175/57 |
| 6,843,333 | B2 | 1/2005 | Richert et al. | |
| 6,959,774 | B2 * | 11/2005 | Nackerud | 175/267 |
| 2010/0000800 | A1 | 1/2010 | Chen et al. | |
| 2010/0219000 | A1 | 9/2010 | Doster | |
| 2010/0320001 | A1 | 12/2010 | Kulkarni | |
| 2011/0031036 | A1 | 2/2011 | Patel | |
| 2011/0259150 | A1 * | 10/2011 | Hall et al. | 76/115 |

* cited by examiner

PDC DISC CUTTERS AND ROTARY DRILL BITS UTILIZING PDC DISC CUTTERS

RELATED APPLICATION

This application claims priority to U.S. application Ser. No. 61/507,503, entitled "PDC Disc Cutters And Rotary Drill Bits Utilizing PDC Disc Cutters," filed Jul. 13, 2011, which is incorporated by reference herein in its entirety.

TECHNICAL FIELD

The present invention relates generally to downhole tools used in drilling a wellbore; and more particularly, to disc cutters and downhole tools, such as rotary drill bits, using one or more disc cutters therein.

BACKGROUND

Disc bits and other downhole tools that use disc cutters for rock formation drilling are known to persons having ordinary skill in the art. These known disc bits range from having two or three large disc cutters, which are aimed to compete with the three-cone type roller cone bits, to having many smaller rolling disc assemblies on the face of the bit.

FIG. 1 is an elevational view of a conventional disc bit 100 in accordance with one example of the prior art. The conventional disc bit 100 includes a sub 110, a first blade 120, and a second blade 130. The sub 110 includes an upper threaded end 112 at one end and a lower bifurcated pivotal end 114 at the opposing end. The sub 110 is in the form of a hollow cylindrical body, but can be shaped differently in other embodiments. The first blade 120 is pivotally coupled to the lower bifurcated pivotal end 114 and is shown in a cutting position 105, which is oriented substantially perpendicular to the length of the sub 110. Similarly, the second blade 130 is pivotally coupled to the lower bifurcated pivotal end 114 and also is shown in the cutting position 105, which is oriented substantially perpendicular to the length of the sub 110 and substantially opposite of the first blade 120. When the first and second blades 120, 130 are positioned in a non-cutting position (not shown), the blades 120, 130 are positioned substantially axially to the sub 110 and positioned substantially below the lower bifurcated pivotal end 114. The blades 120, 130 are pivoted around a portion of the lower bifurcated pivotal end 114 to move one or more of the blades 120, 130 between the cutting position 105 and the non-cutting position.

Each of the blades 120, 130 includes radially offset larger and smaller semi-circular body portions 141, 146. The larger body portion 141 is positioned adjacent the lower bifurcated pivotal end 114, while the smaller body portion 146 extends from the end of the larger body portion 141 to a distance further away from the lower bifurcated pivotal end 114. The smaller body portion 146 includes one or more first cutters 147, each of which are positioned within a corresponding recess 148 formed within the undersurface, or a leading edge 122, of each blade 120, 130. The first cutters 147 are mounted into the recesses 148 using an axle (not shown) extending through the first cutter 147. The first cutters 147 are disk-shaped and are typically uniformly fabricated from tungsten carbide. Each first cutter 147 includes a tapered surface 149 formed radially around the circumference of the first cutter 147. This tapered surface 149 forms a cutting edge 150 for the first cutter 147. The larger body portion 141 includes one or more second cutters 142, each of which are positioned within a corresponding recess 143 formed within the undersurface, or the leading edge 122, of each blade 120, 130. The second cutters 142 are mounted into the recesses 143 using an axle (not shown) extending through the second cutter 142. The second cutters 142 are disk-shaped and are typically uniformly fabricated from tungsten carbide. Each second cutter 142 includes a tapered surface 144 formed radially around the circumference of the second cutter 142. This tapered surface 144 forms a cutting edge 145 for the second cutter 142. Each of the blades 120, 130 also includes one or more cutting inserts 155, typically formed from tungsten carbide, coupled within a corresponding circular recess 156 formed along a trailing edge 124 of each blade 120, 130. Each insert 155 is of a generally elongated cylindrical configuration which protrudes from the trailing edge 124 in order to cut into the formation when the blades 120, 130 are rotated. The cutting inserts 155 are most useful in the event of formation hole collapse, hole sloughing or hole swelling. In operation, the first and second cutters 142, 147 freely rotate around the axle so that a fresh corresponding tapered surface 144, 149 is exposable for cutting the rock formation.

FIG. 2 is a perspective view of a conventional disc bit 200 or head of a conventional shaft in accordance with another example of the prior art. The head 200 includes a generally circular bit body 205, which is adapted to be coupled to a drilling or tunneling machine (not shown) to be rotated and pushed or pulled through a rock or earthen formation to form a wellbore.

A plurality of saddle members 220 are secured to the bit body 205 at various selected locations. A cutter shell or sleeve 230 is carried for rotation by a journal member (not shown), an end of which is secured to and supported by the saddle member 220. Methods of securing journal members to saddle members 220 are known to persons having ordinary skill in the art. A plurality of disc-type cutters 250 are coupled to the face of the bit body 205 using the saddle members 220. The disc-type cutters 250 include a raised, annular kerf ring 255 and are releasably secured to each cutter sleeve or shell 230. As the bit body 205 is rotated and pushed or pulled through the formation, the cutters 250 and the kerf rings 255 engage the formation, scoring it in generally circular patterns and causing the fracture of large cuttings or fragments of rock from the formation. The cuttings (not shown) removed by disc-type cutters 250 are removed with less energy per volume of rock fractured and produce larger cuttings, which are easier to remove from the wellbore as boring progresses.

Currently disc bits are at best used in only an extremely small segment of the overall market for oilfield or blast hole mining drilling. Disc cutters are quite successful though in large diameter tunneling, or raise boring, machines. The historical failure of disc cutters in oilfield applications has been their reliance on relative small diameter axles running through the center of steel or tungsten carbide rolling disc cutters. The axles are prone to breakage from weight-on-bit and rapid wear in the abrasive drilling environment. If the axle and/or the disc interface with the axle is lubricated and sealed, then each disc assembly requires a lubrication and compensation system (not shown) which rapidly consumes the available "real estate" in the bit body. In addition, the steel disc cutters, and even those made of tungsten carbide, are prone to rapid wear of the cutting edge.

In spite of all of the above drawbacks, disc bits continue to attract attention because they offer an entirely different rock failure mechanism than the crushing/scraping of conventional roller cone bits or the shear cutting of conventional PDC bits. Disc bits allow for high point loading on the cutters and fail the rock through a slicing/plowing/spalling mechanism. In many formations, this cutting mechanism can produce very high rates of penetration at relatively low torque levels.

What is needed is a disc cutter and bit design approach that offers the advantages of the high point loading slicing/plowing/spalling available from disc cutters while overcoming the small axle and/or the rapid disc wear drawbacks of disc bits previously in the art.

BRIEF DESCRIPTION OF THE DRAWINGS

The foregoing and other features and aspects of the invention are best understood with reference to the following description of certain exemplary embodiments, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed generally to downhole tools used in drilling a wellbore; and more particularly, to disc cutters and downhole tools, such as rotary drill bits, using one or more disc cutters therein. Although the description of exemplary embodiments is provided below in conjunction with a PDC disc cutter, alternate embodiments of the invention may be applicable to other types of disc cutters and tools using disc cutters including, but not limited to, PCBN disc cutters.

In certain exemplary embodiments, the disc cutters are fabricated having polycrystalline diamond, or some other superhard material such as cubic boron nitride, being pressed onto the sides, and in some cases over the cutting edge, of a substrate disc. The substrate disc is fabricated from tungsten carbide or some other suitable material.

Figure 1:
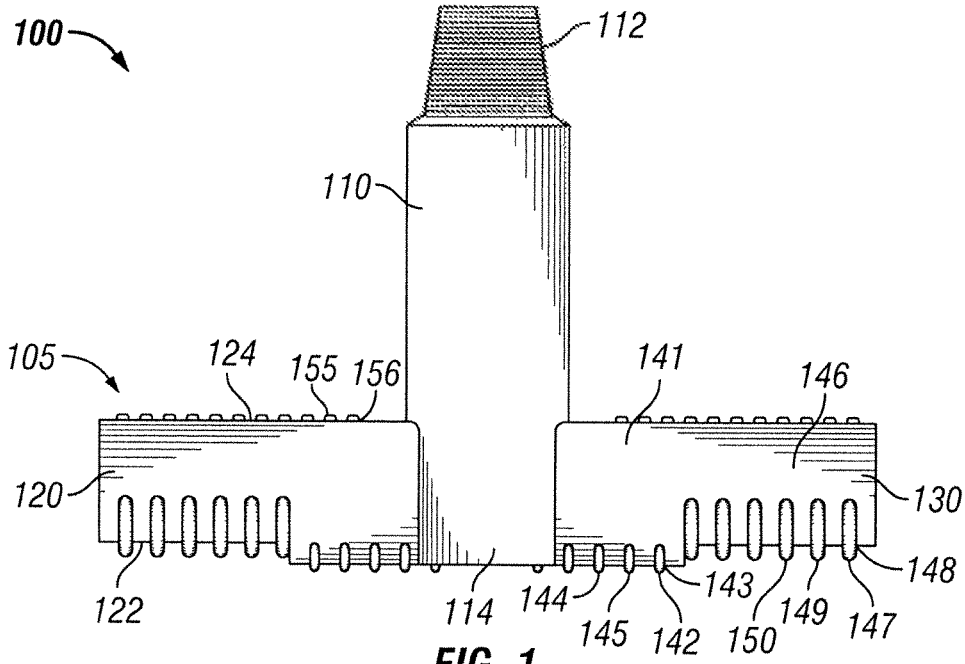
FIG. 1 (Prior Art)
FIG. 1 is an elevational view of a conventional disc bit in accordance with one example of the prior art.
Figure 2:
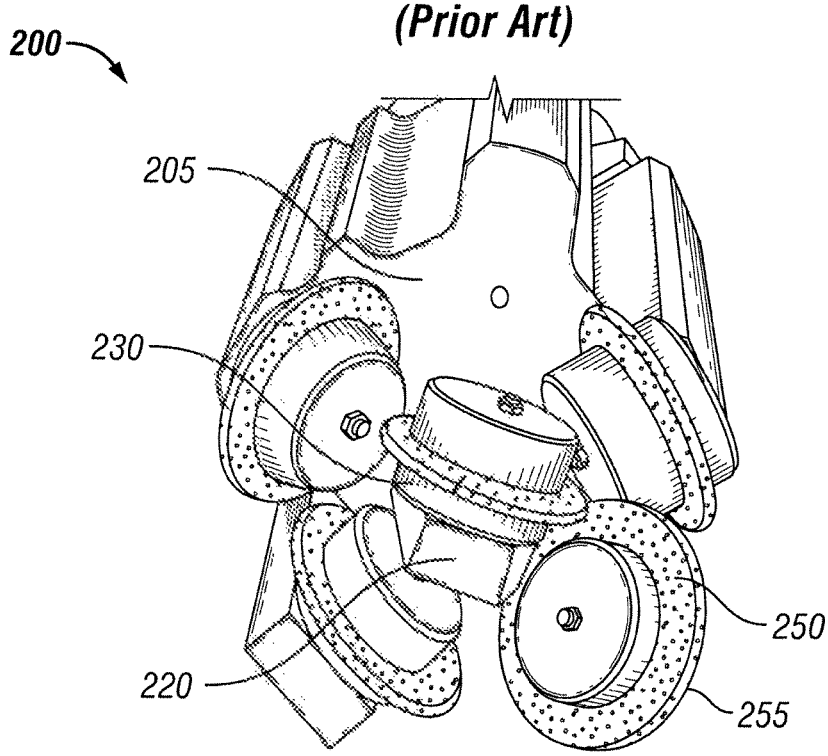
FIG. 2 (Prior Art)
FIG. 2 is a perspective view of a conventional disc bit or head of a conventional shaft in accordance with another example of the prior art.
Figure 3A:
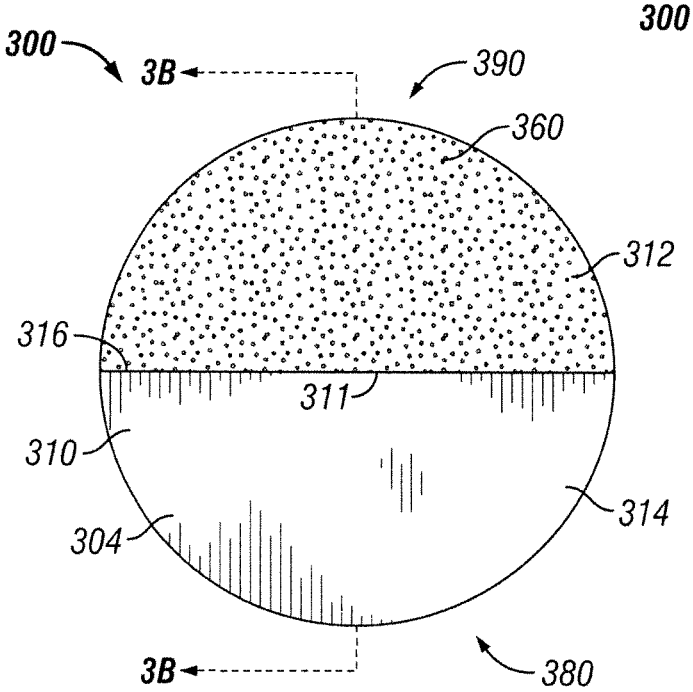
FIG. 3A is a front view of a polycrystalline diamond compact ("PDC") disc cutter in accordance with an exemplary embodiment of the present invention.
Figure 3B:
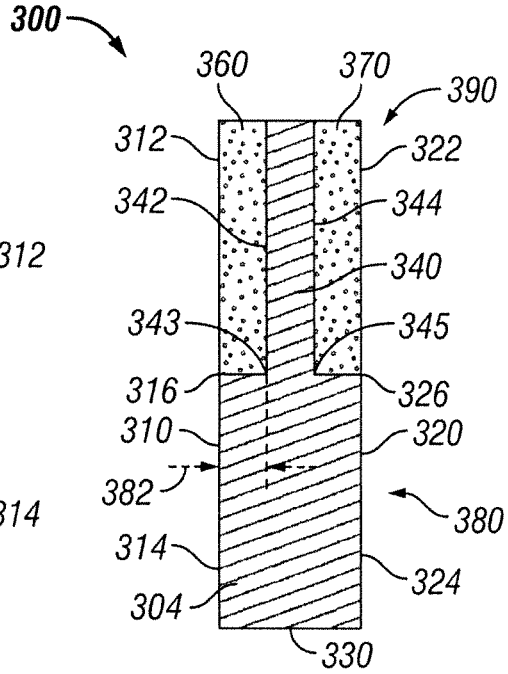
FIG. 3B is a side cross-sectional view of the PDC disc cutter of FIG. 3A.

FIG. 3A is a front view of a polycrystalline diamond compact ("PDC") disc cutter 300 in accordance with an exemplary embodiment of the present invention. FIG. 3B is a side cross-sectional view of the PDC disc cutter 300. Referring to FIGS. 3A and 3B, the PDC disc cutter 300 is cylindrically shaped, or disc-shaped, and includes a first surface 310, a second surface 320, and a sidewall 330 extending from the first surface 310 to the second surface 320.

The first surface 310 is substantially planar and includes a first top portion 312, a first bottom portion 314, and a first interface 316 positioned between the first top portion 312 and the first bottom portion 314. However, the first surface 310 is non-planar in certain exemplary embodiments. In certain exemplary embodiments, the first interface 316 is a diameter of the first surface 310 and forms about a 180 degree angle from a first centerpoint 311 of the first surface 310. However, in other exemplary embodiments, the first interface 316 forms an angle that is either greater than 180 degrees or less than 180 degrees from the first centerpoint 311. Additionally, the first interface 316 is not a diameter of the first surface 310 in certain exemplary embodiments.

Similarly, the second surface 320 is substantially planar and includes a second top portion 322, a second bottom portion 324, and a second interface 326 positioned between the second top portion 322 and the second bottom portion 324. However, the second surface 320 is non-planar in certain exemplary embodiments. In certain exemplary embodiments, the second interface 326 is a diameter of the second surface 320 and forms about a 180 degree angle from a second centerpoint (not shown) of the second surface 320. However, in other exemplary embodiments, the second interface 326 forms an angle that is either greater than 180 degrees or less than 180 degrees from the second centerpoint. Additionally, the second interface 326 is not a diameter of the second surface 320 in certain exemplary embodiments. In certain exemplary embodiments, the second interface 326 is similarly oriented, shaped, and positioned as the first interface 316 and also is aligned with the first interface 316. Thus, the second bottom portion 324 is aligned with the first bottom portion 314 and the second top portion 322 is aligned with the first top portion 312. However, in other exemplary embodiments, the second interface 326 is oriented, shaped, and/or positioned differently than the first interface 316.

In certain exemplary embodiments, the first bottom portion 314 and the second bottom portion 324 are fabricated using a substrate material 304 that extends therebetween to form a lower portion 380 of the PDC disc cutter 300. An intermediate substrate layer 340 extends outwardly from an intermediate depth 382 of the lower portion 380 into an upper portion 390 of the PDC disc cutter 300. The intermediate substrate layer 340 also is fabricated using the substrate material 304 and is of a uniform thickness, according to some exemplary embodiments. In certain exemplary embodiments, the intermediate substrate layer 340 is half disc-shaped and forms a circumferential portion of the sidewall 330 located in the upper portion 390. The intermediate substrate layer 340 includes a first side surface 342 and a second side surface 344. The first side surface 342 faces in the direction of the first surface 310, while the second side surface 344 faces in the direction of the second surface 320. The first side surface 342 extends outwardly from the lower portion 380 at a first transition area 343, while the second side surface 344 extends outwardly from the lower portion 380 at a second transition area 345. According to some exemplary embodiments, the first transition area 343 is about a ninety degree angle; however, this first transition area 343 is less than a ninety degree angle, greater than a ninety degree angle, has a concave-shaped curvature, has a convex-shaped curvature, or has some combination of the previously mentioned transition area types in other exemplary embodiments. Similarly, according to some exemplary embodiments, the second transition area 345 is about a ninety degree angle; however, this second transition area 345 is less than a ninety degree angle, greater than a ninety degree angle, has a concave-shaped curvature, has a convex-shaped curvature, or has some combination of the previously mentioned transition area types in other exemplary embodiments.

The substrate material 304 is a tungsten carbide substrate which is formed from a mixture of tungsten carbide and cobalt powders. The cobalt behaves as a binder material for the tungsten carbide and facilitates formation of the tungsten carbide substrate when exposed to high pressure high temperature ("HPHT") conditions. In certain exemplary embodiments, high cobalt content is used within the substrate material 304 to accommodate side torque stresses on the PDC disc cutters 300 as they wear. Although tungsten carbide and cobalt powders have been provided as example materials for forming the substrate material 304, other materials known to people having ordinary skill in the art, such as a different binder material, can be used to form this substrate material 304. For example, the substrate material 304 is fabricated using a different binder material, such as a molybdenum binder or a nickel binder, in lieu of the cobalt binder. In another example, the substrate material 304 is fabricated using a different carbide, such as a titanium carbide or a molybdenum carbide, in lieu of the tungsten carbide. The substrate material 304 is manufactured using standard sintering techniques, or other techniques, such as microwave sintering.

A first cutting table 360 extends from the first side surface 342 to the first top portion 312. In certain exemplary embodiments, the first cutting table 360 is half disc-shaped and forms a circumferential portion of the sidewall 330 located in the upper portion 390. In certain exemplary embodiments, the first cutting table 360 is a polycrystalline diamond table which is formed from diamond powder and cobalt, which may be infiltrated from the mixture of tungsten carbide and cobalt powders used to form the substrate material 304 during HPHT conditions, which can be in either a HPHT press or in a ultra HPHT press. The cobalt behaves as a catalyst material for sintering the diamond powder to form diamond-diamond bonds. The diffusion of cobalt into the diamond powder results in cobalt being deposited within the voids formed within the first cutting table 360. However, according to certain exemplary embodiments, at least a portion of this deposited cobalt is removed from the voids, thereby creating a thermally stable first cutting table 360. Depending upon the exemplary embodiment, the cobalt is completely removed, partially removed, removed in patterns, or randomly removed from the first cutting table 360. Some processes used to remove this cobalt includes, but is not limited to, acid leaching, electrolysis removal, and other known processes. Thus, the superhard material layer that forms the first cutting table 360 can be rich in catalyst material, such as cobalt, average in catalyst material, or lean in catalyst material depending upon design choices. Although diamond powder and cobalt have been provided as example materials for forming the first cutting table 360, other materials known to people having ordinary skill in the art, such as cubic boron nitride and/or a different catalyst material, can be used to form this first cutting table 360. For example, in certain exemplary embodiments, the first cutting table 360 is fabricated using other superhard materials, such as impregnated diamond matrix or cubic boron nitride. If the first cutting table 360 is made from diamond, the polycrystalline diamond feedstock can be of natural diamond or synthetic diamond. The grain size of the diamond feedstock is one of fine gained, medium gained, large grained, or a combination of different grain sizes. If the first cutting table 360 is made from impregnated diamond matrix, the diamond grains may be of natural diamond or synthetic diamond. The superhard material layer of an impregnated diamond disc may be applied in a standard furnace, a microwave furnace, a hot isostatic press, or any other know furnaces and/or presses. If the first cutting table 360 is made from impregnated diamond matrix, the diamond grains may be of natural diamond or synthetic diamond. According to certain exemplary embodiments, the superhard material layer that forms the cutting table 360 is between about 0.010 inches and about 0.125 inches; however, this thickness is greater or smaller in other exemplary embodiments.

Additionally, the superhard material layer of the first cutting table 360 may be of a transitional nature wherein the diamond content of the outer layer of the superhard material has a higher concentration of diamond and an inner layer or layers have a lower concentration of diamond. This transition in diamond content from the outer layers to the inner layers is progressive in some exemplary embodiments, while the transition is step-wise in other exemplary embodiments. Further, the superhard material layer of the first cutting table 360 may include zones of thermally stable polycrystalline diamond. Moreover, the superhard material layer may have serrations, holes, grooves, or other features to enhance cleaning, cooling, cutter aggressiveness, or cutter durability.

A second cutting table 370 extends from the second side surface 344 to the second top portion 322. In certain exemplary embodiments, the second cutting table 370 is half disc-shaped and forms a circumferential portion of the sidewall 330 located in the upper portion 390. The second cutting table 370 is formed similarly to any one of the examples provided above with respect to the first cutting table 360. The first cutting table 360, the intermediate substrate layer 340, and the second cutting table 370 form the upper portion 390 of the PDC disc cutter 300. In certain exemplary embodiments, however, a portion of the intermediate substrate layer 340 is replaced with either the first cutting table 360 or the second cutting table 370 without departing from the scope and spirit of the exemplary embodiments. Additionally, in certain exemplary embodiments, the first cutting table 360 is fabricated from one or more different materials than the second cutting table 370.

Figure 4A:
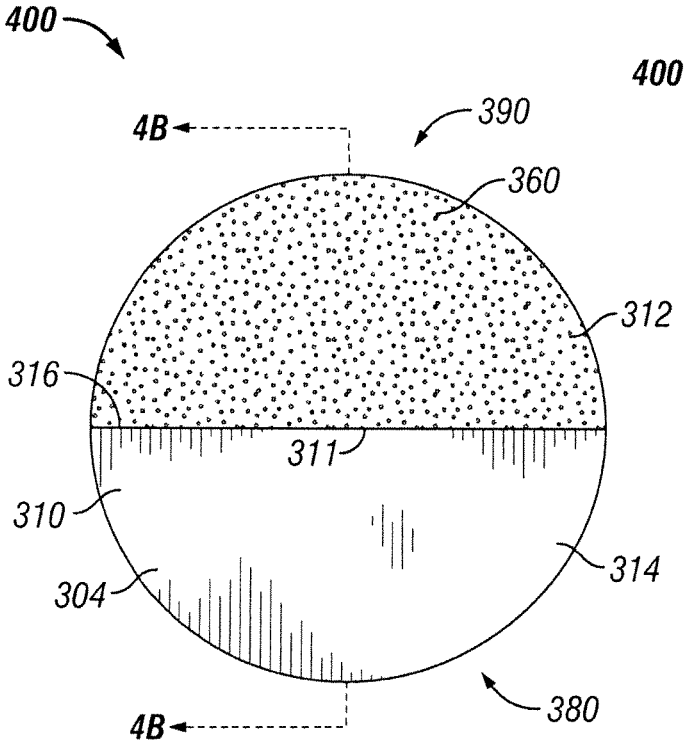
FIG. 4A is a front view of a PDC disc cutter in accordance with another exemplary embodiment of the present invention.
Figure 4B:
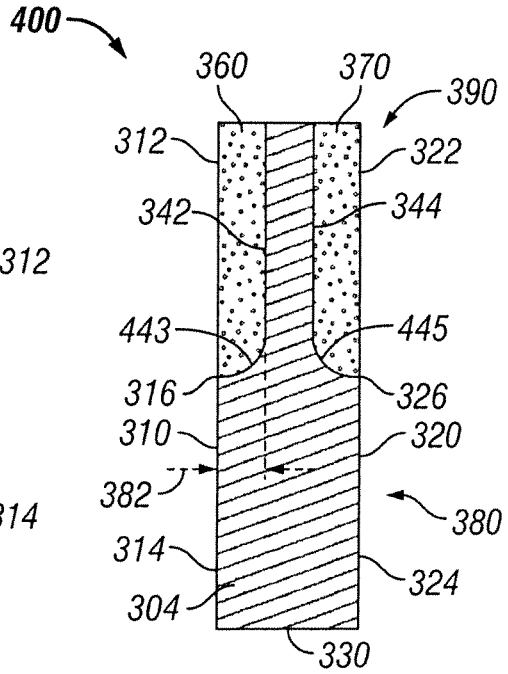
FIG. 4B is a side cross-sectional view of the PDC disc cutter of FIG. 4A.

FIG. 4A is a front view of a PDC disc cutter 400 in accordance with another exemplary embodiment of the present invention. FIG. 4B is a side cross-sectional view of the PDC disc cutter 400. Referring to FIGS. 4A and 4B, the PDC disc cutter 400 is cylindrically shaped, or disc-shaped, and includes a first surface 310, a second surface 320, and a sidewall 330 extending from the first surface 310 to the second surface 320.

The first surface 310 is substantially planar and includes a first top portion 312, a first bottom portion 314, and a first interface 316 positioned between the first top portion 312 and the first bottom portion 314. However, the first surface 310 is non-planar in certain exemplary embodiments. In certain exemplary embodiments, the first interface 316 is a diameter of the first surface 310 and forms about a 180 degree angle from a first centerpoint 311 of the first surface 310. However, in other exemplary embodiments, the first interface 316 forms an angle that is either greater than 180 degrees or less than 180 degrees from the first centerpoint 311. Additionally, the first interface 316 is not a diameter of the first surface 310 in certain exemplary embodiments.

Similarly, the second surface 320 is substantially planar and includes a second top portion 322, a second bottom portion 324, and a second interface 326 positioned between the second top portion 322 and the second bottom portion 324. However, the second surface 320 is non-planar in certain exemplary embodiments. In certain exemplary embodiments, the second interface 326 is a diameter of the second surface 320 and forms about a 180 degree angle from a second centerpoint (not shown) of the second surface 320. However, in other exemplary embodiments, the second interface 326 forms an angle that is either greater than 180 degrees or less than 180 degrees from the second centerpoint. Additionally, the second interface 326 is not a diameter of the second surface 320 in certain exemplary embodiments. In certain exemplary embodiments, the second interface 326 is similarly oriented, shaped, and positioned as the first interface 316 and also is aligned with the first interface 316. Thus, the second bottom portion 324 is aligned with the first bottom portion 314 and the second top portion 322 is aligned with the first top portion 312. However, in other exemplary embodiments, the second interface 326 is oriented, shaped, and/or positioned differently than the first interface 316.

In certain exemplary embodiments, the first bottom portion 314 and the second bottom portion 324 are fabricated using a substrate material 304 that extends therebetween to form a lower portion 380 of the PDC disc cutter 400. An intermediate substrate layer 340 extends outwardly from an intermediate depth 382 of the lower portion 380 into an upper portion 390 of the PDC disc cutter 400. The intermediate substrate layer 340 also is fabricated using the substrate material 304 and is of a uniform thickness, according to some exemplary embodiments. In certain exemplary embodiments, the intermediate substrate layer 340 is half disc-shaped and forms a circumferential portion of the sidewall 330 located in the upper portion 390. The intermediate substrate layer 340 includes a first side surface 342 and a second side surface 344. The first side surface 342 faces in the direction of the first surface 310, while the second side surface 344 faces in the direction of the second surface 320. The first side surface 342 extends outwardly from the lower portion 380 at a first transition area 443, while the second side surface 344 extends outwardly from the lower portion 380 at a second transition area 445. According to some exemplary embodiments, the first transition area 443 has a concave-shaped curvature. Similarly, according to some exemplary embodiments, the second transition area 445 has a concave-shaped curvature. The first transition area 443 transitions from the first interface 316 to the first side surface 342, while the second transition area 445 transitions from the second interface 326 to the second side surface 344.

The substrate material 304 is a tungsten carbide substrate which is formed from a mixture of tungsten carbide and cobalt powders. However, the substrate material 304 has been previously described with respect to FIG. 3A and applies herein with respect to all the described embodiments.

A first cutting table 360 extends from the first side surface 342 to the first top portion 312. In certain exemplary embodiments, the first cutting table 360 is half disc-shaped and forms a circumferential portion of the sidewall 330 located in the upper portion 390. The cutting table 360 has been previously described with respect to FIG. 3A and applies herein with respect to all the described embodiments.

A second cutting table 370 extends from the second side surface 344 to the second top portion 322. In certain exemplary embodiments, the second cutting table 370 is half disc-shaped and forms a circumferential portion of the sidewall 330 located in the upper portion 390. The second cutting table 370 is formed similarly to any one of the examples provided above with respect to the first cutting table 360. The first cutting table 360, the intermediate substrate layer 340, and the second cutting table 370 form the upper portion 390 of the PDC disc cutter 300. In certain exemplary embodiments, however, a portion of the intermediate substrate layer 340 is replaced with either the first cutting table 360 or the second cutting table 370 without departing from the scope and spirit of the exemplary embodiments. Additionally, in certain exemplary embodiments, the first cutting table 360 is fabricated from one or more different materials than the second cutting table 370.

Figure 5A:
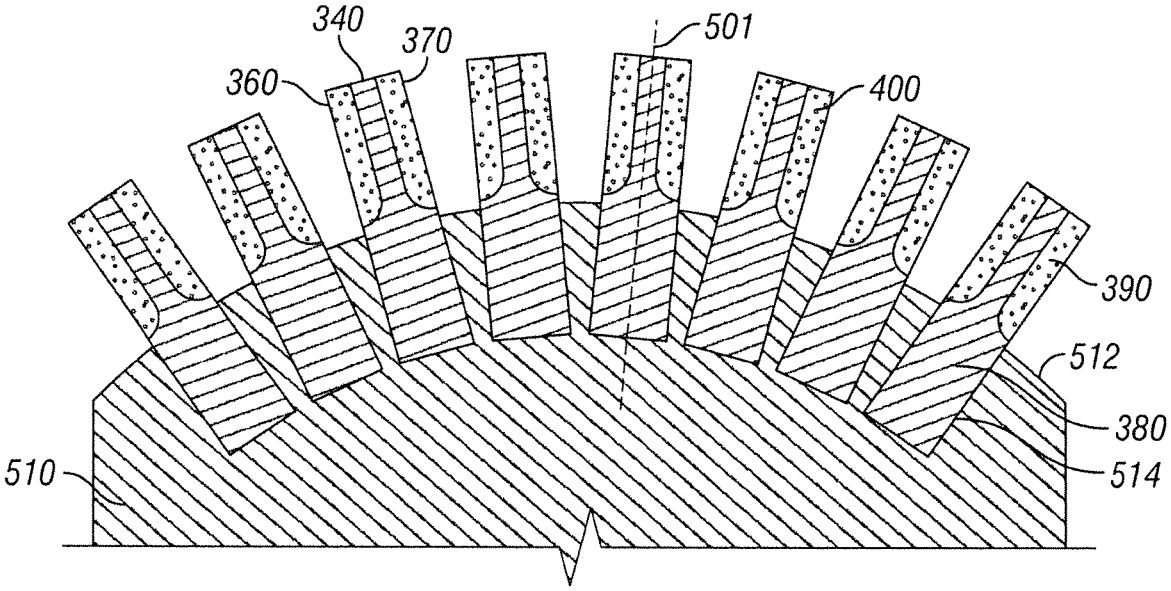
FIG. 5A is a side cross-sectional view of a portion of a blade on a disc bit illustrating the PDC disc cutters of FIGS. 4A and 4B mounted therein in accordance with an exemplary embodiment of the present invention.
Figure 5B:
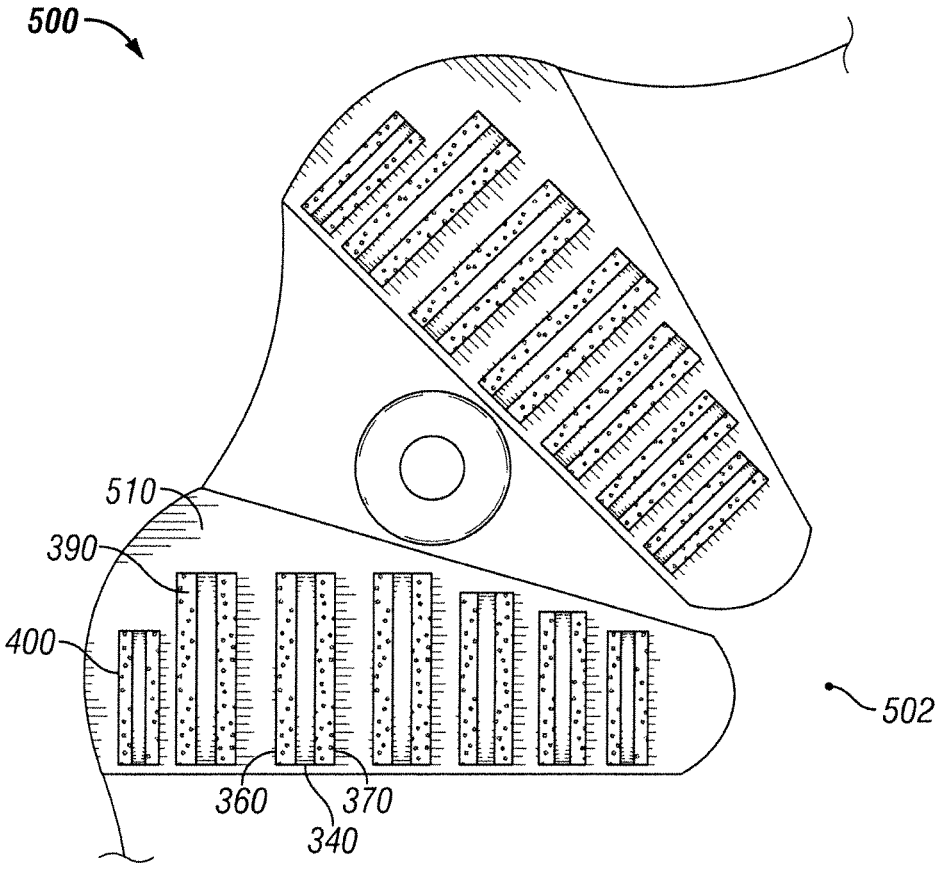
FIG. 5B is a top view of two consecutive blades on a portion of the disc bit of FIG. 5A in accordance with an exemplary embodiment of the present invention.

FIG. 5A is a side cross-sectional view of a portion of a blade 510 on a disc bit 500 illustrating the PDC disc cutters 400 mounted therein in accordance with an exemplary embodiment of the present invention. FIG. 5B is a top view of two consecutive blades 510 on a portion of the disc bit 500 in accordance with an exemplary embodiment of the present invention. Referring to FIGS. 5A and 5B, the disc bit 500 includes a plurality of blades 510 extending outwardly from a disc bit centerline 502. Each blade 510 includes at least one PDC disc cutter 400 mounted thereto via gluing or brazing. If the PDC disc cutter 400 is brazed onto the blade 510, the brazing is performed using torch brazing or furnace brazing. The disc bit 500 is made from tungsten carbide matrix, but can be made from steel, tungsten matrix, titanium matrix, or some other suitable material.

Each blade 510 includes a mounting surface 512 which generally faces a portion of the wellbore (not shown) once disposed within the wellbore. The mounting surface 512 generally has a convex-shaped curvature that includes one or more cavities 514 formed therein. The cavities 514 are formed during the molding process in forming the blade 510. Alternatively, the blade 510 is formed and thereafter the cavities 514 are formed therein via drilling or some other known method. Alternatively, the cavities 514 are formed using other methods known to persons having ordinary skill in the art. Each cavity 514 is configured to receive a portion of a corresponding PDC disc cutter 400 via brazing or any other known method. Thus, one or more of the PDC disc cutters 400 are fixedly coupled to the blade 510. At least a portion of the lower portion 380 of each PDC disc cutter 400 is coupled within the corresponding cavity 514, while at least a portion of the upper portion 390 of each PDC disc cutter 400 is exposed beyond the mounting surface 512. Thus, the first cutting table 360, the second cutting table 370, and an edge of the intermediate substrate layer 340 are exposed to cut into the wellbore during drilling.

The PDC disc cutters 400 are aligned one after another and are inserted substantially the same depth into each of the corresponding cavities 514. However, one or more of the PDC disc cutters 400 are inserted substantially at a different depth into the corresponding cavity 514 than at least one other PDC disc cutter 400, thereby providing for different cutter exposure levels. For example, alternating PDC disc cutters 400 are inserted at a first depth, while intervening PDC disc cutters 400, wherein a single intervening PDC disc cutter 400 is positioned between two alternating disc cutters 400, are inserted at a second depth. According to some exemplary embodiments, a central axis 501 of one or more of the PDC disc cutters 400 is oriented substantially perpendicular to the mounting surface 512. However, in other exemplary embodiments, the central axis 501 of one or more PDC disc cutters 400 is oriented non-perpendicularly to the mounting surface 512. In some exemplary embodiments, one or more PDC disc cutters 400 are a different size than at least one other PDC disc cutter 400. For example, in certain exemplary embodiments, the smaller PDC disc cutters 400 are coupled into the blade 510 closer to the disc bit centerline 502, while the larger PDC disc cutters 400 are coupled within the blade 510 further away from the disc bit centerline 502. At times, this configuration is determinable by the shape and available surface area of the blade 510 as it extends away form the disc bit centerline 502. Also, according to some exemplary embodiments, the PDC disc cutters 400 are deployed on a disc bit 500 in a stepwise manner. For example, the disc bit 500 can have a frusto-conical shape with concentric platforms at progressively higher elevations going from the outer perimeter of the disc bit 500 towards the disc bit centerline 502. One or more PDC disc cutters 400 are deployed on each differently elevated concentric platform in a concentric manner. Although some different profiles have been described with respect to the bit 500, the bit 500 can be of many other profile types including, but not limited to, flat profile, shallow parabolic profile, long parabolic profile, and intermediate parabolic profile.

Additionally, one or more of the PDC disc cutters 400 are slightly side raked to reduce side loading stresses on a trailing edge of the PDC disc cutters 400. Side raking, which is the angling of the back portion of the PDC disc cutter 400 towards the central axis 501, facilitates the PDC disc cutters 400 to track better in the circumferential cut made by a leading portion of the PDC disc cutter 400. This side rake angle is between one degree and eighty-nine degrees depending upon the exemplary embodiment. In other exemplary embodiments, the side rake angle is greater or less than the aforementioned angles.

Further, according to some exemplary embodiments, one or more of the blades 510 of the disc bit 500 includes more than one row of disc cutters 400. In certain exemplary embodiments, the disc bit 500 utilizes a combination of disc cutters 400 and shear cutters (not shown), which are known in the art. For example, one blade 510 includes alternating disc cutters 400 and shear cutters in a row. In another example, the shear cutters are positioned at bit center, while the disc cutters 400 are positioned at the nose of the bit 500 and/or at the shoulder of the bit 500. In a further example, the shear cutters are positioned at the gage of the bit 500, while the disc cutters 400 are positioned at the nose of the bit 500 and/or at the shoulder of the bit 500. Alternatively, instead of being intermixed with regular shear cutters on a bit, the disc cutters 400 are intermixed with impregnated segments or impregnated posts.

Figure 6A:
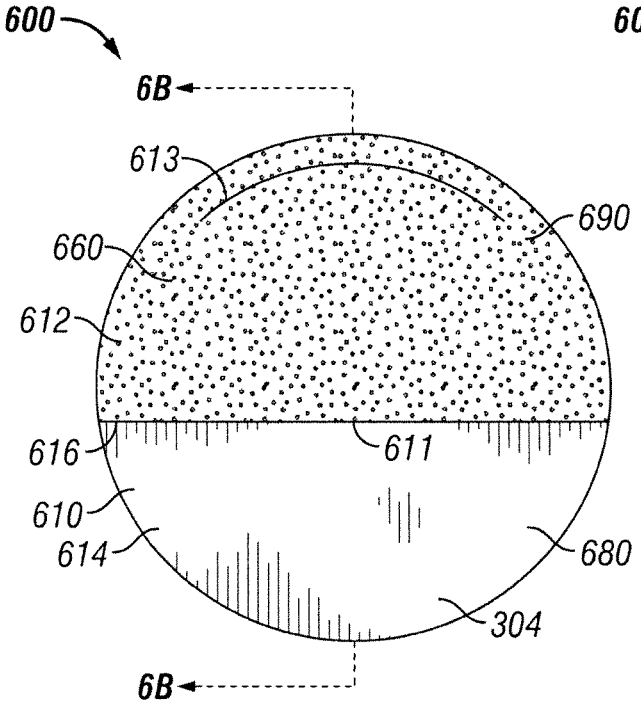
FIG. 6A is a front view of a PDC disc cutter in accordance with a third exemplary embodiment of the present invention.
Figure 6B:
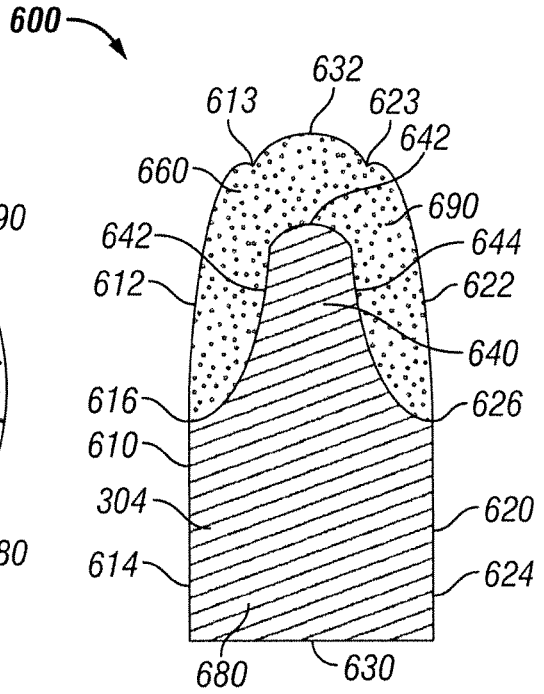
FIG. 6B is a side cross-sectional view of the PDC disc cutter of FIG. 6A.

FIG. 6A is a front view of a PDC disc cutter 600 in accordance with a third exemplary embodiment of the present invention. FIG. 6B is a side cross-sectional view of the PDC disc cutter 600. Referring to FIGS. 6A and 6B, the PDC disc cutter 600 is cylindrically shaped, or disc-shaped, and includes a first surface 610, a second surface 620, and a sidewall 630 extending from the first surface 610 to the second surface 620.

The first surface 610 includes a first top portion 612, a first bottom portion 614, and a first interface 616 positioned between the first top portion 612 and the first bottom portion 614. In certain exemplary embodiments, the first interface 616 is a diameter of the first surface 610 and forms about a 180 degree angle from a first centerpoint 611 of the first surface 610. However, in other exemplary embodiments, the first interface 616 forms an angle that is either greater than 180 degrees or less than 180 degrees from the first centerpoint 611. Additionally, the first interface 616 is not a diameter of the first surface 610 in certain exemplary embodiments. The first top portion 612 includes a first groove 613 formed at a distal portion of the first top portion 612 near a portion of the sidewall 630. The first groove 613 is arcuately shaped, but is shaped differently in other exemplary embodiments. The first top portion 612 is non-planar in that the portion near the sidewall 630 and is curve-shaped as it converges with the sidewall 630. The first bottom portion 614 is substantially planar, but can be non-planar in certain exemplary embodiments.

Similarly, the second surface 620 includes a second top portion 622, a second bottom portion 624, and a second interface 626 positioned between the second top portion 622 and the second bottom portion 624. In certain exemplary embodiments, the second interface 626 is a diameter of the second surface 620 and forms about a 180 degree angle from a second centerpoint (not shown) of the second surface 620. However, in other exemplary embodiments, the second interface 626 forms an angle that is either greater than 180 degrees or less than 180 degrees from the second centerpoint. Additionally, the second interface 626 is not a diameter of the second surface 620 in certain exemplary embodiments. In certain exemplary embodiments, the second interface 626 is similarly oriented, shaped, and positioned as the first interface 616 and also is aligned with the first interface 616. Thus, the second bottom portion 624 is aligned with the first bottom portion 614 and the second top portion 622 is aligned with the first top portion 612. However, in other exemplary embodiments, the second interface 626 is oriented, shaped, and/or positioned differently than the first interface 616. The second top portion 622 includes a second groove 623 formed at a distal portion of the second top portion 622 near a portion of the sidewall 630. The second groove 623 is arcuately shaped, but is shaped differently in other exemplary embodiments. The second top portion 622 is non-planar in that the portion near the sidewall 630 and is curve-shaped as it converges with the sidewall 630. The second bottom portion 624 is substantially planar, but can be non-planar in certain exemplary embodiments.

At least a portion of the sidewall 630 extending from the first top portion 612 to the second top portion 622 has a convex-shaped side profile 632. However, in other exemplary embodiments, this portion of the sidewall 630 has a different side profile shape, such as planar or concave-shaped, without departing from the scope and spirit of the exemplary embodiments.

In certain exemplary embodiments, the first bottom portion 614 and the second bottom portion 624 are fabricated using a substrate material 304 that extends therebetween to form a lower portion 680 of the PDC disc cutter 600. An intermediate substrate layer 640 extends outwardly from the lower portion 680 into an upper portion 690 of the PDC disc cutter 600. According to certain exemplary embodiments, the intermediate substrate layer 640 extends a greater distance from the lower portion 680 near the center portion of the lower portion 680 than near its edges. In these exemplary embodiments, a distal end 646 of the intermediate substrate layer 640 is non-planar. The intermediate substrate layer 640 also is fabricated using the substrate material 304 and is of a non-uniform thickness, according to some exemplary embodiments. In certain exemplary embodiments, the intermediate substrate layer 640 is about half disc-shaped. The intermediate substrate layer 640 includes a first side surface 642 and a second side surface 644. The first side surface 642 faces in the direction of the first surface 610, while the second side surface 644 faces in the direction of the second surface 620. The first side surface 642 extends inwardly into the PDC disc cutter 600 from the first interface 616 and continues to the distal end 646 of the intermediate substrate layer 640, which is positioned in the upper portion 690 near the sidewall 630 in the upper portion 690. The first side surface 642 has a substantially half-parabolic shape; however, this shape is different in other exemplary embodiments. Similarly, the second side surface 644 extends inwardly into the PDC disc cutter from the second interface 626 and continues to the distal end 646 of the intermediate substrate layer 640. The second side surface 644 has a substantially half-parabolic shape; however, this shape is different in other exemplary embodiments. The distal end 646 is convexed-shaped in certain exemplary embodiments, but is differently shaped, such as being planar or being concave-shaped, in other exemplary embodiments.

As previously mentioned, the substrate material 304 is a tungsten carbide substrate which is formed from a mixture of tungsten carbide and cobalt powders. This substrate material 304 has been previously described with respect to FIG. 3A and applies herein with respect to all the described embodiments.

A cutting table 660 is formed in the upper portion 690 and extends from the first side surface 642 to the first top portion 612, from the second side surface 644 to the second top portion 622, and from the remaining portions of the intermediate substrate layer 640, including the distal end 646, to the sidewall 630 in the upper portion 690; thereby forming a circumferential portion of the sidewall 630 located in the upper portion 690. In certain exemplary embodiments, the cutting table 660 is formed similarly to the first cutting table 360 described with respect to FIG. 3A and with respect to all of the described embodiments.

Figure 7:
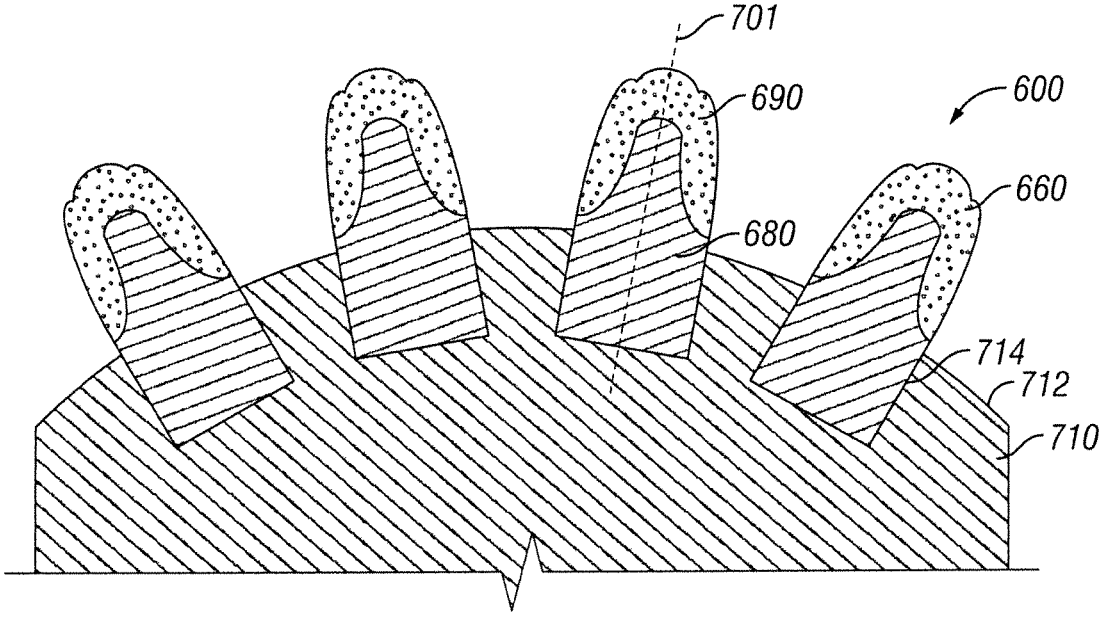
FIG. 7 is a side cross-sectional view of a portion of a blade on a disc bit illustrating the PDC disc cutters of FIGS. 6A and 6B mounted therein in accordance with an exemplary embodiment of the present invention.

FIG. 7 is a side cross-sectional view of a portion of a blade 710 on a disc bit (not shown) illustrating the PDC disc cutters 600 mounted therein in accordance with an exemplary embodiment of the present invention. Referring to FIG. 7, the disc bit includes one or more blades 710, of which only one is illustrated, where each blade 710 includes at least one PDC disc cutter 600 mounted thereto.

Each blade 710 includes a mounting surface 712 which generally faces a portion of the wellbore (not shown) once disposed within the wellbore. The mounting surface 712 generally has a convex-shaped curvature that includes one or more cavities 714 formed therein. The cavities 714 are formed during the molding process in forming the blade 710. Alternatively, the blade 710 is formed and thereafter the cavities 714 are formed therein via drilling or some other known method. Alternatively, the cavities 714 are formed using other methods known to persons having ordinary skill in the art. Each cavity 714 is configured to receive a portion of a corresponding PDC disc cutter 600 via brazing or any other known method. Thus, one or more of the PDC disc cutters 600 are fixedly coupled to the blade 710. At least a portion of the lower portion 680 of each PDC disc cutter 600 is coupled within the corresponding cavity 714, while at least a portion of the upper portion 690 of each PDC disc cutter 600 is exposed beyond the mounting surface 712. Thus, the cutting table 660 is exposed to cut into the wellbore during drilling.

The PDC disc cutters 600 are aligned one after another and are inserted substantially the same depth into each of the corresponding cavities 714. However, one or more of the PDC disc cutters 600 are inserted substantially at a different depth into the corresponding cavity 714 than at least one other PDC disc cutter 600 in other exemplary embodiments. For example, alternating PDC disc cutters 600 are inserted at a first depth, while intervening PDC disc cutters 600, wherein one or more intervening PDC disc cutters 600 are positioned between two alternating disc cutters 600, are inserted at a second depth. According to some exemplary embodiments, a central axis 701 one or more of the PDC disc cutters 600 is oriented substantially perpendicular to the mounting surface 712. However, in other exemplary embodiments, the central axis 701 of one or more PDC disc cutters 600 is oriented non-perpendicularly to the mounting surface 712. In some exemplary embodiments, one or more PDC disc cutters 600 are a different size than at least one other PDC disc cutter 600.

Figure 8A:
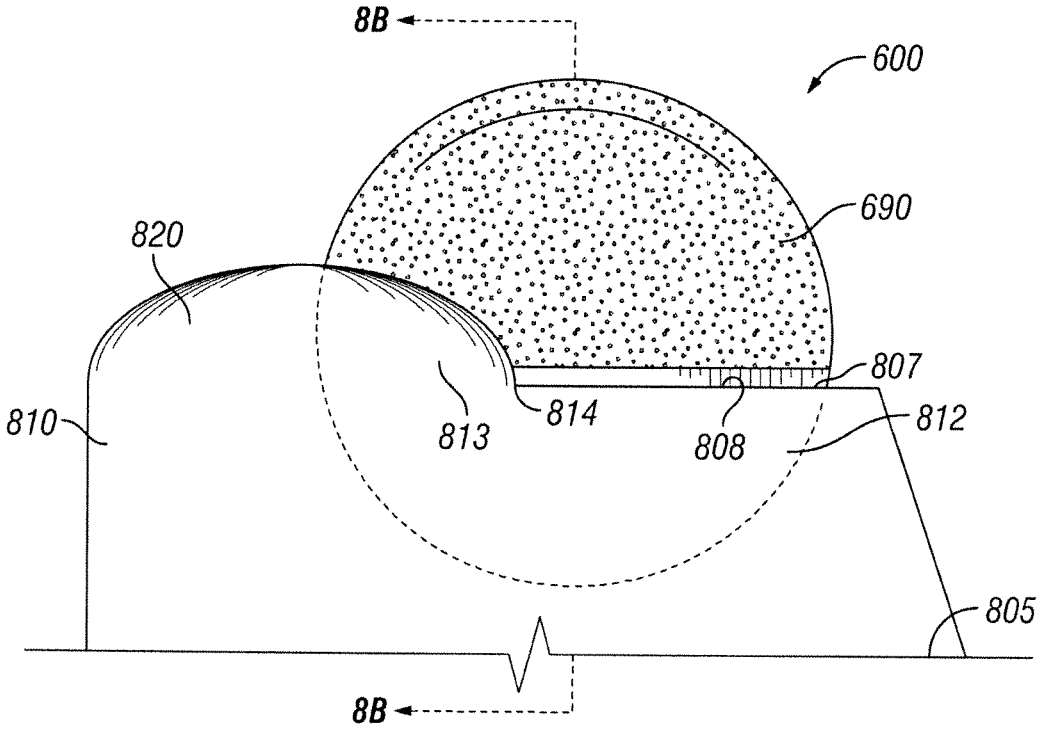
FIG. 8A is a front view of the PDC disc cutter of FIGS. 6A and 6B mounted into a matrix pocket formed within a blade of a disc bit in accordance with another exemplary embodiment of the present invention.
Figure 8B:
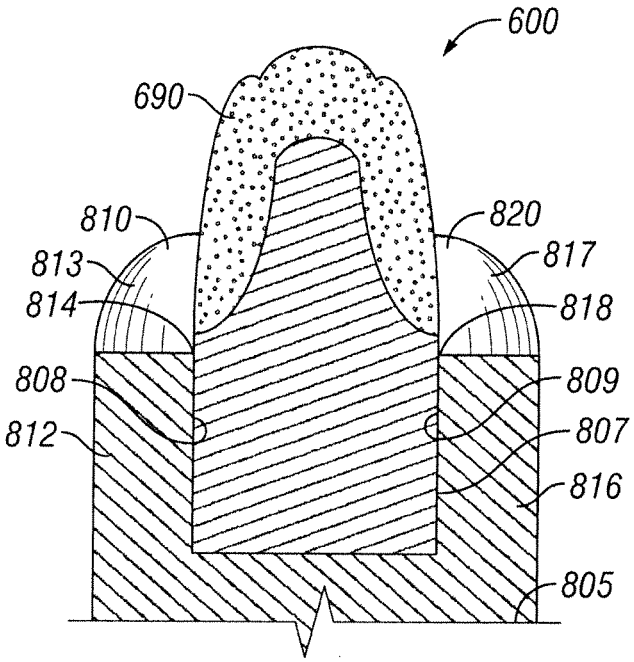
FIG. 8B is a side cross-sectional view of the PDC disc cutter of FIGS. 6A and 6B mounted into the matrix pocket of FIG. 8A.

FIG. 8A is a front view of the PDC disc cutter 600 mounted into a matrix pocket 810 formed within a blade 805 of a disc bit (not shown) in accordance with another exemplary embodiment of the present invention. FIG. 8B is a side cross-sectional view of the PDC disc cutter 600 mounted into the matrix pocket 810 of FIG. 8A. Referring to FIGS. 8A and 8B, the blade 805 includes a cavity 807 formed therein. The cavity 807 is longitudinally shaped and configured to receive a portion of the PDC disc cutter 600 therein. The cavity 807 forms a first blade edge 808 adjacent to one longitudinal side of the cavity 807 and a second blade edge 809 adjacent to the opposing longitudinal side of the cavity 807. The cavity 807 is formed according to any of the methods known to persons having ordinary skill in the art. The blade 805 is formed from a tungsten carbide material according to some exemplary embodiments, but is formed from steel or any other known suitable material in other exemplary embodiments.

The matrix pocket 810 includes a first support edge 812, a second support edge 816, and a rear support edge 820 extending from one end of the first support edge 812 to a corresponding end of the second support edge 816. A portion of the first support edge 812 extends outwardly from a portion of the first blade edge 808 in an upwardly direction and has an arcuately-shaped profile along a distal end 813 of the first support edge 812. This shape is different according to other exemplary embodiments. This portion of the first support edge 812 extends outwardly from a first intermediate area 814 along the first blade edge 808 to the end of the first blade edge 808. Also, the first support edge 812 extends outwards a greater distance from the end of the first blade edge 808 than from the first intermediate area 814.

Similarly, a portion of the second support edge 816 extends outwardly from a portion of the second blade edge 809 in an upwardly direction and has an arcuately-shaped profile along a distal end 817 of the second support edge 816. Thus, a portion of the cavity 807 is disposed between the first support edge 812 and the second support edge 816. This shape is different according to other exemplary embodiments. This portion of the second support edge 816 extends outwardly from a first intermediate area 818 along the second blade edge 809 to the end of the second blade edge 809 that is opposite and nearer to the end of the first blade edge 808. Also, the second support edge 816 extends outwards a greater distance from the end of the second blade edge 809 than from the first intermediate area 818. In certain exemplary embodiments, the second support edge 816 is a mirror-image of the first support edge 812.

The rear support edge 820 extends from the end of the first support edge 812 and the end of the first blade edge 808 to the end of the second support edge 816 and the end of the second blade edge 809. The rear support edge 820 has an arcuately-shaped profile at its ends and has a substantially planar profile at its upper portion between the first support edge 812 and the second support edge 816 according to certain exemplary embodiments; however, this shape is different in other exemplary embodiments.

The first support edge 812, the second support edge 816, and the rear support edge 820 are formed integrally as a single component. The matrix pocket 810 surrounds a portion of the longitudinal edges of the cavity 807 and one end of a latitudinal edge of the cavity 807. The matrix pocket 810 is elevationally raised compared to the elevation of the blade 805.

The matrix pocket 810 is fabricated from a similar material as the blade 805 and is used to provide support to the PDC disc cutter 600 once inserted and coupled within the cavity 807. The matrix pocket 810 is formed on a portion of the blade 805. In certain exemplary embodiments, the matrix pocket 810 is formed at the same time the blade 805 is formed and also is formed integrally with the blade 805 pursuant to methods known to persons having ordinary skill in the art and having the benefit of the present disclosure.

The PDC disc cutter 600 is inserted and coupled within the cavity 807 pursuant to coupling methods known to persons having ordinary skill in the art, such as brazing methods. The PDC disc cutter 600 is further supported, during cutting operations within the wellbore, by the matrix pocket 810. Once inserted within the cavity 807, a portion of the upper portion 690 is exposed for cutting, while a remaining portion of the upper portion 690 is concealed by the matrix pocket 810. The PDC disc cutter 600 is fixedly attached within the cavity 807. Alternatively, an axle (not shown) can be inserted through a rotatable disc cutter that is inserted into the cavity 807. One end of the axle can be supported by the first support edge 812, while an opposing end of the axle can be supported by the second support edge 816. In this alternative exemplary embodiment, the rear support edge 820 is optional. Although PDC disc cutter 600 is shown as being used in conjunction with the matrix pocket 810, any PDC disc cutter can be used with the matrix pocket 810.

Figure 9A:
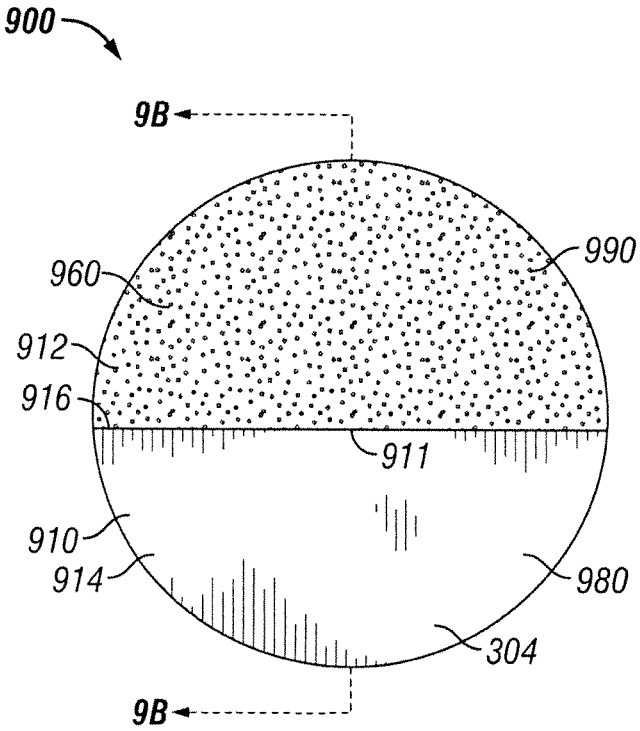
FIG. 9A is a front view of a PDC disc cutter in accordance with a fourth exemplary embodiment of the present invention.
Figure 9B:
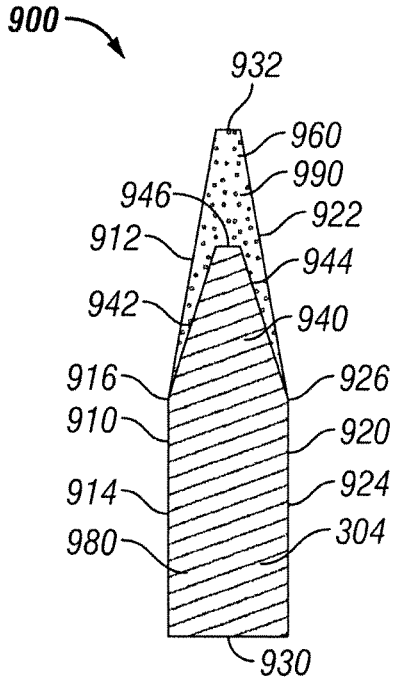
FIG. 9B is a side cross-sectional view of the PDC disc cutter of FIG. 9A.

FIG. 9A is a front view of a PDC disc cutter 900 in accordance with a fourth exemplary embodiment of the present invention. FIG. 9B is a side cross-sectional view of the PDC disc cutter 900. Referring to FIGS. 9A and 9B, the PDC disc cutter 900 is disc-shaped and includes a first surface 910, a second surface 920, and a sidewall 930, having a non-uniform thickness, extending from the first surface 910 to the second surface 920.

The first surface 910 includes a first top portion 912, a first bottom portion 914, and a first interface 916 positioned between the first top portion 912 and the first bottom portion 914. In certain exemplary embodiments, the first interface 916 is a diameter of the first surface 910 and forms about a 180 degree angle from a first centerpoint 911 of the first surface 910. However, in other exemplary embodiments, the first interface 916 forms an angle that is either greater than 180 degrees or less than 180 degrees from the first centerpoint 911. Additionally, the first interface 916 is not a diameter of the first surface 910 in certain exemplary embodiments. The first bottom portion 914 is substantially planar, but can be non-planar in certain exemplary embodiments. The first top portion 912 also is substantially planar, but extends towards the second surface 920 as it extends away from the first interface 916. Thus, the first top portion 912 is non-planar with respect to the first bottom portion 914.

Similarly, the second surface 920 includes a second top portion 922, a second bottom portion 924, and a second interface 926 positioned between the second top portion 922 and the second bottom portion 924. In certain exemplary embodiments, the second interface 926 is a diameter of the second surface 920 and forms about a 180 degree angle from a second centerpoint (not shown) of the second surface 920. However, in other exemplary embodiments, the second interface 926 forms an angle that is either greater than 180 degrees or less than 180 degrees from the second centerpoint. Additionally, the second interface 926 is not a diameter of the second surface 920 in certain exemplary embodiments. In certain exemplary embodiments, the second interface 926 is similarly oriented, shaped, and positioned as the first interface 916 and also is aligned with the first interface 916. Thus, the second bottom portion 924 is aligned with the first bottom portion 914 and the second top portion 922 is aligned with the first top portion 912. However, in other exemplary embodiments, the second interface 926 is oriented, shaped, and/or positioned differently than the first interface 916. The second bottom portion 924 is substantially planar, but can be non-planar in certain exemplary embodiments. The second bottom portion 924 is substantially parallel to the first bottom portion 914 in certain exemplary embodiments. The second top portion 922 also is substantially planar, but extends towards the first surface 910 as it extends away from the second interface 926. Thus, the second top portion 922 is non-planar with respect to the second bottom portion 924. Hence, from a side view, the first top portion 912 and the second top portion 922 form a substantially cone-shaped profile.

At least a portion of the sidewall 930 extending from the first top portion 912 to the second top portion 922 has a planar side profile 932. However, in other exemplary embodiments, this portion of the sidewall 930 has a different side profile shape, such as convex-shaped or concave-shaped, without departing from the scope and spirit of the exemplary embodiments.

In certain exemplary embodiments, the first bottom portion 914 and the second bottom portion 924 are fabricated using a substrate material 304 that extends therebetween to form a lower portion 980 of the PDC disc cutter 900. An intermediate substrate layer 940 extends outwardly from both the first interface 916 and the second interface 926 into an upper portion 990 of the PDC disc cutter 900. According to certain exemplary embodiments, the intermediate substrate layer 940 extends a greater distance from the lower portion 980 near the center portion of the lower portion 980 than near its edges. In these exemplary embodiments, a distal end 946 of the intermediate substrate layer 940 is non-planar. The intermediate substrate layer 940 also is fabricated using the substrate material 304 and is of a non-uniform thickness, according to some exemplary embodiments. Thus, the thickness of the intermediate substrate layer 940 reduces as it extends further away from the lower portion 980. In certain exemplary embodiments, the intermediate substrate layer 940 is about half disc-shaped. The intermediate substrate layer 940 includes a first side surface 942 and a second side surface 944. The first side surface 942 faces in the direction of the first surface 910, while the second side surface 944 faces in the direction of the second surface 920. The first side surface 942 extends inwardly into the upper portion 990 of the PDC disc cutter 900 from the first interface 916 and continues to the distal end 946 of the intermediate substrate layer 940, which is positioned in the upper portion 990 near the sidewall 930 in the upper portion 990. The first side surface 942 is substantially planar; however, this shape is different in other exemplary embodiments. Similarly, the second side surface 944 extends inwardly into the upper portion 990 of the PDC disc cutter 900 from the second interface 926 and continues to the distal end 946 of the intermediate substrate layer 940. The second side surface 944 is substantially planar; however, this shape is different in other exemplary embodiments. The distal end 946, when viewed from a side cross-sectional view, is planar in certain exemplary embodiments, but is differently shaped, such as being convex-shaped or being concave-shaped, in other exemplary embodiments.

As previously mentioned, the substrate material 304 is a tungsten carbide substrate which is formed from a mixture of tungsten carbide and cobalt powders. This substrate material 304 has been previously described with respect to FIG. 3A and applies herein with respect to all the described embodiments.

A cutting table 960 is formed in the upper portion 990 and extends from the first side surface 942 to the first top portion 912, from the second side surface 944 to the second top portion 922, and from the remaining portions of the intermediate substrate layer 940, including the distal end 946, to the sidewall 930 in the upper portion 990; thereby forming a circumferential portion of the sidewall 930 located in the upper portion 990. The cutting table 960 is formed similarly to the first cutting table 360 (FIG. 3A) along with any of its several embodiments described.

Figure 10A:
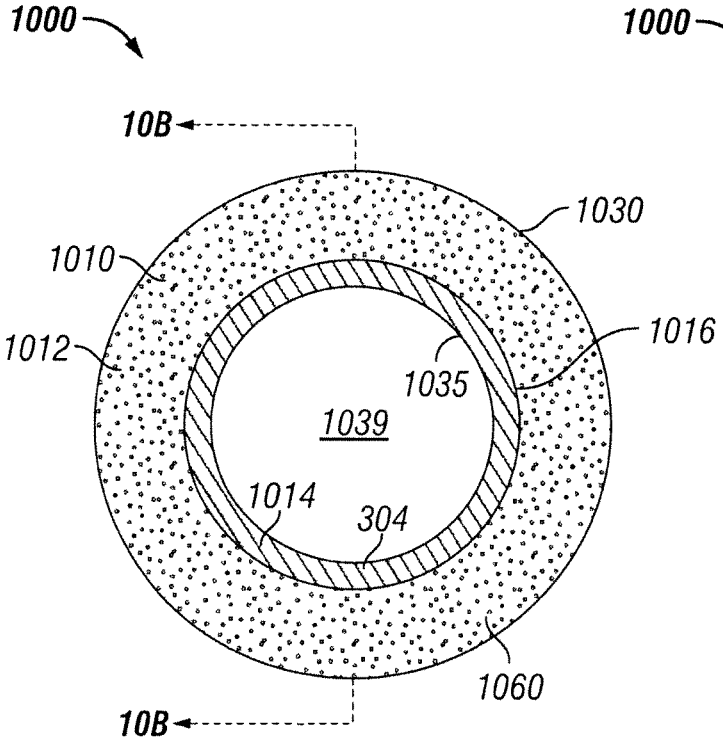
FIG. 10A is a front view of a PDC disc cutter in accordance with a fifth exemplary embodiment of the present invention.
Figure 10B:
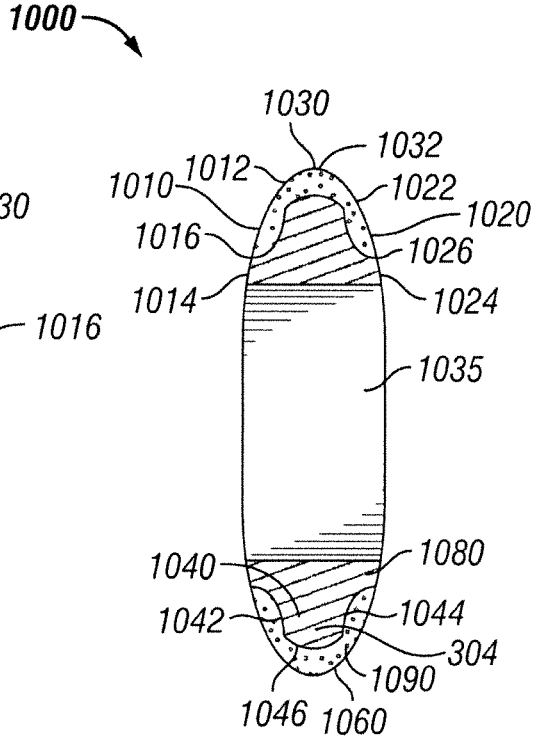
FIG. 10B is a side cross-sectional view of the PDC disc cutter of FIG. 10A.

FIG. 10A is a front view of a PDC disc cutter 1000 in accordance with a fifth exemplary embodiment of the present invention. FIG. 10B is a side cross-sectional view of the PDC disc cutter 1000. Referring to FIGS. 10A and 10B, the PDC disc cutter 1000 is annularly disc-shaped, and includes a first surface 1010, a second surface 1020, an outer sidewall 1030 extending from an outer perimeter of the first surface 1010 to an outer perimeter of the second surface 1020, an inner sidewall 1035 extending from an inner perimeter of the first surface 1010 to an inner perimeter of the second surface 1020, and channel 1039 extending from the first surface 1010 to the second surface 1020 and defined by the inner sidewall 1035.

The first surface 1010 includes a first outer portion 1012, a first inner portion 1014, and a first interface 1016 positioned between the first outer portion 1012 and the first inner portion 1014. In certain exemplary embodiments, the first interface 1016 is circularly shaped and is disposed circumferentially and concentrically between the inner sidewall 1035 and the outer sidewall 1030. In certain exemplary embodiments, the first inner portion 1014 is non-planar and extends outwardly from the inner sidewall 1035. In certain exemplary embodiments, the first outer portion 1012 also is non-planar and extends outwardly from the end of the first inner portion 1014 to the outer sidewall 1030, where the first outer portion 1012 converges into the outer sidewall 1030. However, in certain alternative exemplary embodiments, one or more of the first outer portion 1012 and the first inner portion 1014 are planar.

Similarly, the second surface 1020 includes a second outer portion 1022, a second inner portion 1024, and a second interface 1026 positioned between the second outer portion 1022 and the second inner portion 1024. In certain exemplary embodiments, the second interface 1026 is circularly shaped and is disposed circumferentially and concentrically between the inner sidewall 1035 and the outer sidewall 1030. In certain exemplary embodiments, the second interface 1026 is similarly oriented, shaped, and positioned as the first interface 1016 and also is aligned with the first interface 1016. Thus, the second inner portion 1024 is aligned with the first inner portion 1014 and the second outer portion 1022 is aligned with the first outer portion 1012. However, in other exemplary embodiments, the second interface 1026 is oriented, shaped, and/or positioned differently than the first interface 1016. In certain exemplary embodiments, the second inner portion 1024 is non-planar and extends outwardly from the inner sidewall 1035. In certain exemplary embodiments, the second outer portion 1022 also is non-planar and extends outwardly from the end of the second inner portion 1024 to the outer sidewall 1030, where the second outer portion 1022 converges into the outer sidewall 1030. However, in certain alternative exemplary embodiments, one or more of the second outer portion 1022 and the second inner portion 1024 are planar.

At least a portion of the outer sidewall 1030 extending from the first outer portion 1012 to the second outer portion 1022 has a convex-shaped side profile 1032. However, in other exemplary embodiments, this portion of the outer sidewall 1030 has a different side profile shape, such as planar or concave-shaped, without departing from the scope and spirit of the exemplary embodiments.

In certain exemplary embodiments, the first inner portion 1014 and the second inner portion 1024 are fabricated using a substrate material 304 that extends therebetween to form an inner portion 1080 of the PDC disc cutter 1000. An intermediate substrate layer 1040 extends outwardly from the inner portion 1080 into an outer portion 1090 of the PDC disc cutter 1000. The intermediate substrate layer 1040 also is fabricated using the substrate material 304 and is of a non-uniform thickness, according to some exemplary embodiments. The intermediate substrate layer 1040 includes a first side surface 1042 and a second side surface 1044. The first side surface 1042 faces in the direction of the first surface 1010, while the second side surface 1044 faces in the direction of the second surface 1020. The first side surface 1042 extends inwardly into the PDC disc cutter 1000 from the first interface 1016 and continues to a distal end 1046 of the intermediate substrate layer 1040, which is positioned in the outer portion 1090 near the outer sidewall 1030 in the outer portion 1090. The first side surface 1042 has a substantially half-parabolic shape; however, this shape is different in other exemplary embodiments. Similarly, the second side surface 1044 extends inwardly into the PDC disc cutter 1000 from the second interface 1026 and continues to the distal end 1046 of the intermediate substrate layer 1040. The second side surface 1044 has a substantially half-parabolic shape; however, this shape is different in other exemplary embodiments. The distal end 1046 is convex-shaped in certain exemplary embodiments, but is differently shaped, such as being planar or being concave-shaped, in other exemplary embodiments. The distal end 1046 extends around the inner portion 1080 of the PDC disc cutter 1000.

As previously mentioned, the substrate material 304 is a tungsten carbide substrate which is formed from a mixture of tungsten carbide and cobalt powders. This substrate material 304 has been previously described with respect to FIG. 3A and applies herein with respect to all the described embodiments.

A cutting table 1060 is formed in the outer portion 1090 and extends from the first side surface 1042 to the first outer portion 1012, from the second side surface 1044 to the second outer portion 1022, and from the remaining portions of the intermediate substrate layer 1040, including the distal end 1046, to the outer sidewall 1030 in the upper portion 1090; thereby forming a circumferential portion of the outer sidewall 1030 located in the outer portion 1090. In certain exemplary embodiments, the cutting table 1060 is formed similarly to the first cutting table 360 (FIG. 3A) along with any of its several embodiments described.

The PDC disc cutter 1000 is rotatably coupled to a disc bit (not shown). An axle (not shown) mountable, either directly or indirectly, onto the disc bit is inserted through the channel 1039 which allows the PDC disc cutter 1000 to rotate around the axle. The diameter of the channel 1039 is larger than channels formed in prior art rotatable disc cutters since the PDC disc cutter 1000 has a much slower rate of wear than steel or tungsten carbide discs. Thus, the distance between the outer sidewall 1030 and the inner sidewall 1035 can be made smaller. Hence, a larger axle is insertable through the channel 1039. This larger axle is more durable and has less breakage and/or cracking issues due to its larger diameter size.

In certain exemplary embodiments, the rotating disc cutter 1000 may have a diamond radial bearing surface coated with carbon vapor deposition (CVD) diamond material, or may have polycrystalline diamond radial bearings as are known in the art. If PDC, the inner surface of the disc 1000 is set with PDCs having concave faces which conform to the outer diameter of the axle the disc 1000 is mounted on. The axle may be set with convex PDCs to form a constantly engaged diamond radial bearing.

Figure 11A:
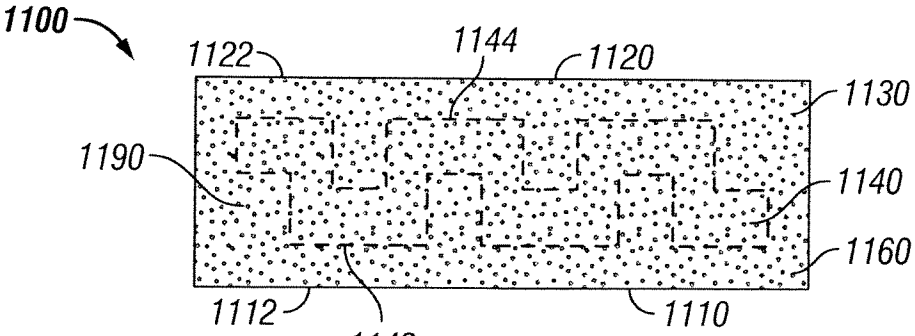
FIG. 11A is a top view of a PDC disc cutter in accordance with a sixth exemplary embodiment of the present invention.
Figure 11B:
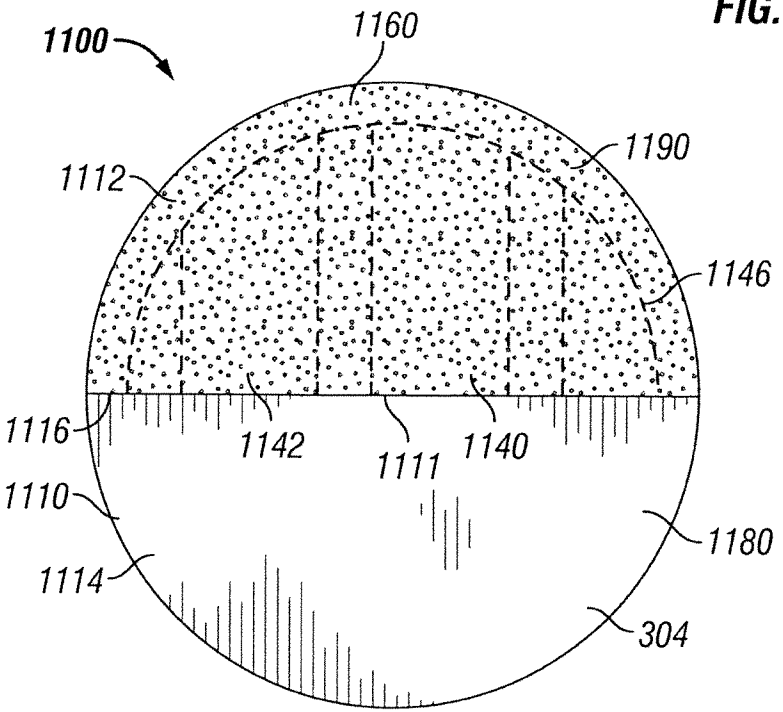
FIG. 11B is a side view of the PDC disc cutter of FIG. 11A.
Figure 11C:
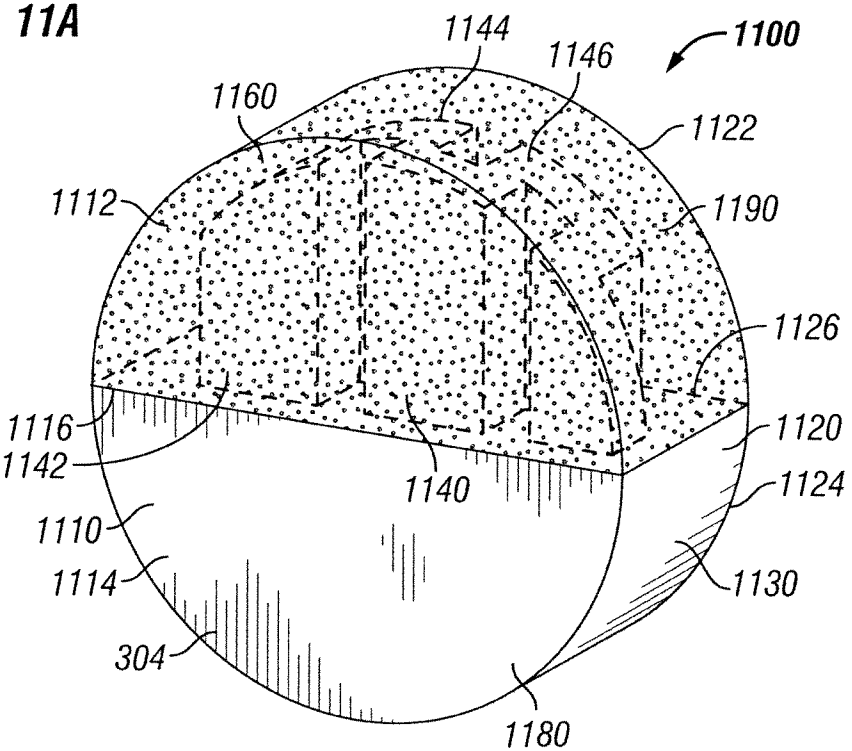
FIG. 11C is a perspective view of the PDC disc cutter of FIG. 11A.

FIG. 11A is a top view of a PDC disc cutter 1100 in accordance with a sixth exemplary embodiment of the present invention. FIG. 11B is a side view of the PDC disc cutter 1100. FIG. 11C is a perspective view of the PDC disc cutter 1100. Referring to FIGS. 11A-11C, the PDC disc cutter 1100 is disc-shaped and includes a first surface 1110, a second surface 1120, and a sidewall 1130, having a substantially uniform thickness, extending from the first surface 1110 to the second surface 1120.

The first surface 1110 includes a first top portion 1112, a first bottom portion 1114, and a first interface 1116 positioned between the first top portion 1112 and the first bottom portion 1114. In certain exemplary embodiments, the first interface 1116 is a diameter of the first surface 1110 and forms about a 180 degree angle from a first centerpoint 1111 of the first surface 1110. However, in other exemplary embodiments, the first interface 1116 forms an angle that is either greater than 180 degrees or less than 180 degrees from the first centerpoint 1111. Additionally, the first interface 1116 is not a diameter of the first surface 1110 in certain exemplary embodiments. The first bottom portion 1114 is substantially planar, but can be non-planar in certain exemplary embodiments. The first top portion 1112 also is substantially planar, but can be non-planar or non-planar with respect to the first bottom portion 1114 and extend towards the second surface 1120 as it extends away from the first interface 1116.

Similarly, the second surface 1120 includes a second top portion 1122, a second bottom portion 1124, and a second interface 1126 positioned between the second top portion 1122 and the second bottom portion 1124. In certain exemplary embodiments, the second interface 1126 is a diameter of the second surface 1120 and forms about a 180 degree angle from a second centerpoint (not shown) of the second surface 1120. However, in other exemplary embodiments, the second interface 1126 forms an angle that is either greater than 180 degrees or less than 180 degrees from the second centerpoint. Additionally, the second interface 1126 is not a diameter of the second surface 1120 in certain exemplary embodiments. In certain exemplary embodiments, the second interface 1126 is similarly oriented, shaped, and positioned as the first interface 1116 and also is aligned with the first interface 1116. Thus, the second bottom portion 1124 is aligned with the first bottom portion 1114 and the second top portion 1122 is aligned with the first top portion 1112. However, in other exemplary embodiments, the second interface 1126 is oriented, shaped, and/or positioned differently than the first interface 1116. The second bottom portion 1124 is substantially planar, but can be non-planar in certain exemplary embodiments. The second bottom portion 1124 is substantially parallel to the first bottom portion 1114 in certain exemplary embodiments. The second top portion 1122 also is substantially planar, but can be non-planar or non-planar with respect to the second bottom portion 1124 and extend towards the first surface 1110 as it extends away from the second interface 1126.

At least a portion of the sidewall 1130 extending from the first top portion 1112 to the second top portion 1122 has a planar side profile 1132 and is arcuately shaped. However, in other exemplary embodiments, this portion of the sidewall 1130 has a different side profile shape, such as convex-shaped or concave-shaped, without departing from the scope and spirit of the exemplary embodiments.

In certain exemplary embodiments, the first bottom portion 1114 and the second bottom portion 1124 are fabricated using a substrate material 304 that extends therebetween to form a lower portion 1180 of the PDC disc cutter 1100. An intermediate substrate layer 1140 extends outwardly from the lower portion 1180 into an upper portion 1190 of the PDC disc cutter 1100. According to certain exemplary embodiments, the intermediate substrate layer 1140 extends a greater distance from the lower portion 1180 near the center portion of the lower portion 1180 than near its edges. In these exemplary embodiments, a distal end 1146 of the intermediate substrate layer 1140 is non-planar. The intermediate substrate layer 1140 also is fabricated using the substrate material 304 and is serpentine-shaped, according to some exemplary embodiments. The serpentine-shape includes at least one right angle formed within the shape according to some exemplary embodiments. In certain exemplary embodiments, the serpentine-shape includes at least one curvature formed within the shape. In certain exemplary embodiments, the intermediate substrate layer 1140 includes a first side surface 1142, which is non-planar, and a second side surface 1144, which also is non-planar. The first side surface 1142 faces in the direction of the first surface 1110, while the second side surface 1144 faces in the direction of the second surface 1120. The first side surface 1142 extends inwardly into the upper portion 1190 of the PDC disc cutter 1100 from the lower portion 1180 and continues to the distal end 1146 of the intermediate substrate layer 1140, which is positioned in the upper portion 1190. Similarly, the second side surface 1144 extends inwardly into the upper portion 1190 of the PDC disc cutter 1100 from the lower portion 1180 and continues to the distal end 1146 of the intermediate substrate layer 1140. The distal end 1146 is planar in certain exemplary embodiments, but is differently shaped, such as being convex-shaped or being concave-shaped, in other exemplary embodiments.

As previously mentioned, the substrate material 304 is a tungsten carbide substrate which is formed from a mixture of tungsten carbide and cobalt powders. This substrate material 304 has been previously described with respect to FIG. 3A and applies herein with respect to all the described embodiments.

A cutting table 1160 is formed in the upper portion 1190 and extends from the first side surface 1142 to the first top portion 1112, from the second side surface 1144 to the second top portion 1122, and from the remaining portions of the intermediate substrate layer 1140, including the distal end 1146, to the sidewall 1130 in the upper portion 1190; thereby forming a circumferential portion of the sidewall 1130 located in the upper portion 1190. In certain exemplary embodiments, the cutting table 1160 is a polycrystalline diamond table which is formed similarly to the first cutting table 360 (FIG. 3A) along with any of its several embodiments described.

Figure 12:
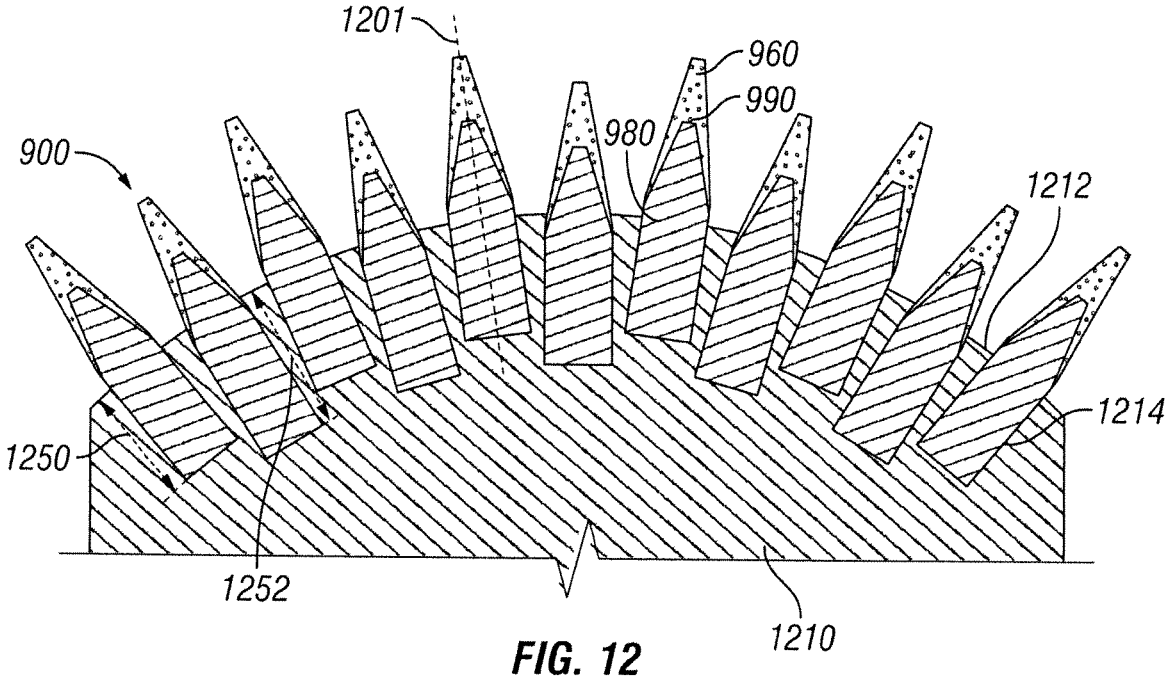
FIG. 12 is a side cross-sectional view of a portion of a blade on a disc bit illustrating the PDC disc cutters of FIGS. 9A and 9B mounted therein in accordance with an exemplary embodiment of the present invention.

FIG. 12 is a side cross-sectional view of a portion of a blade 1210 on a disc bit (not shown) illustrating the PDC disc cutters 900 of FIGS. 9A and 9B mounted therein in accordance with an exemplary embodiment of the present invention. Referring to FIG. 12, the disc bit includes a plurality of blades 1210 extending outwardly from a disc bit centerline (not shown). Each blade 1210 includes at least one PDC disc cutter 900 mounted thereto.

Each blade 1210 includes a mounting surface 1212 which generally faces a portion of the wellbore (not shown) once disposed within the wellbore. The mounting surface 1212 generally has a convex-shaped curvature that includes one or more cavities 1214 formed therein. The cavities 1214 are formed during the molding process in forming the blade 1210. Alternatively, the blade 1210 is formed and thereafter the cavities 1214 are formed therein via drilling or some other known method. Alternatively, the cavities 1214 are formed using other methods known to persons having ordinary skill in the art. Each cavity 1214 is configured to receive a portion of a corresponding PDC disc cutter 900 via brazing or any other known method. Thus, one or more of the PDC disc cutters 900 are fixedly coupled to the blade 1210. At least a portion of the lower portion 980 of each PDC disc cutter 900 is coupled within the corresponding cavity 1214, while at least a portion of the upper portion 990 of each PDC disc cutter 900 is exposed beyond the mounting surface 1212. Thus, at least a portion of the first cutting table 960 is exposed to cut into the wellbore during drilling.

The PDC disc cutters 900 are aligned one after another in the same row and are inserted into each of the corresponding cavities 1214 with adjacently positioned PDC disc cutters 900 being at different depths, thereby providing for cutters 900 having different cutting exposures. For example, alternating PDC disc cutters 900 are inserted at a first depth 1250, while intervening PDC disc cutters 900, which are positioned between two alternating disc cutters 900, are inserted at a second depth 1252 which is different than the first depth 1250. In certain exemplary embodiments, at least one PDC disc cutter 900 is inserted into a corresponding cavity 1214 at a different depth than at least one other PDC disc cutters 900. However, in alternative exemplary embodiments, one or more PDC disc cutters 900 are not aligned within the same row. According to some exemplary embodiments, a central axis 1201 of one or more of the PDC disc cutters 900 is oriented substantially perpendicular to the mounting surface 1212. However, in other exemplary embodiments, the central axis 1201 of one or more PDC disc cutters 900 is oriented non-perpendicularly to the mounting surface 1212.

Figure 13:
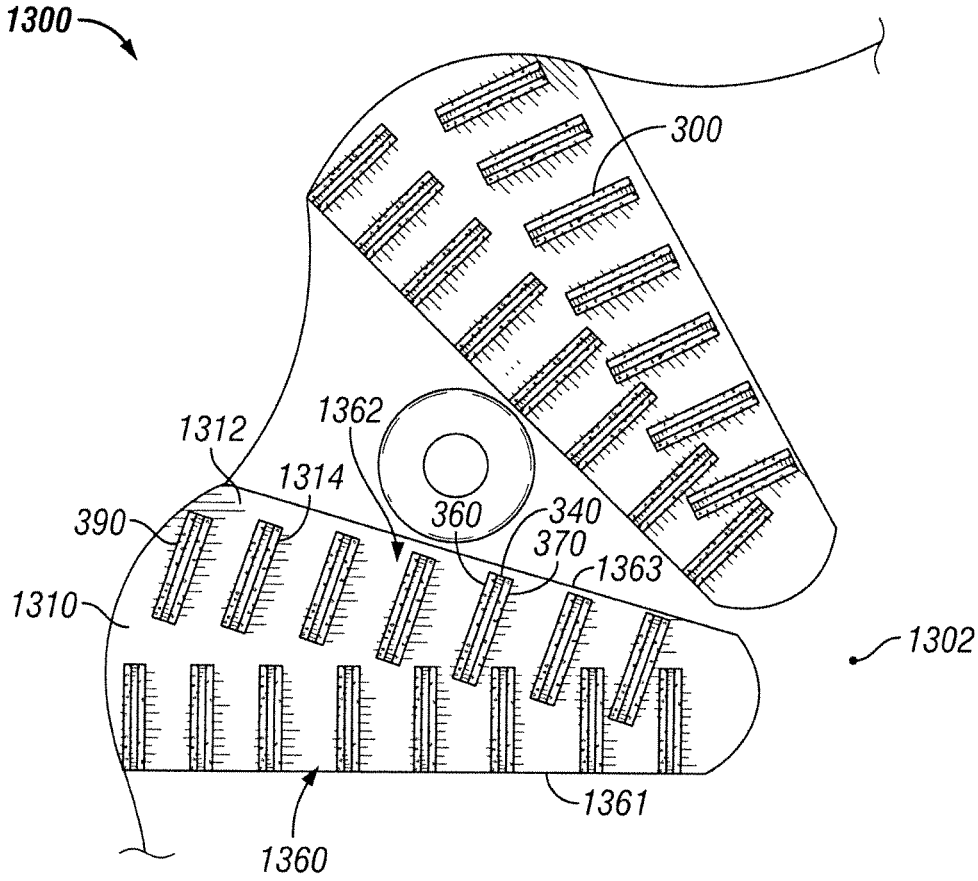
FIG. 13 is a top view of two consecutive blades on a portion of a disc bit illustrating the PDC disc cutters of FIGS. 3A and 3B mounted therein in accordance with an exemplary embodiment of the present invention.

FIG. 13 is a top view of two consecutive blades 1310 on a portion of a disc bit 1300 illustrating the PDC disc cutters 300 of FIGS. 3A and 3B mounted therein in accordance with an exemplary embodiment of the present invention. Referring to FIG. 13, the disc bit 1300 includes a plurality of blades 1310 extending outwardly from a disc bit centerline 1302. Each blade 1310 includes at least one PDC disc cutter 300 mounted thereto.

Each blade 1310 includes a mounting surface 1312 which generally faces a portion of the wellbore (not shown) once disposed within the wellbore. The mounting surface 1312 generally has a convex-shaped curvature that includes one or more cavities 1314 formed therein. The cavities 1314 are formed during the molding process in forming the blade 1310. Alternatively, the blade 1310 is formed and thereafter the cavities 1314 are formed therein via drilling or some other known method. Alternatively, the cavities 1314 are formed using other methods known to persons having ordinary skill in the art. Each cavity 1314 is configured to receive a portion of a corresponding PDC disc cutter 300 via brazing or any other known method. Thus, one or more of the PDC disc cutters 300 are fixedly coupled to the blade 1310. At least a portion of the lower portion 380 (FIG. 3A) of each PDC disc cutter 300 is coupled within the corresponding cavity 1314, while at least a portion of the upper portion 390 of each PDC disc cutter 300 is exposed beyond the mounting surface 1312. Thus, the first cutting table 360, the second cutting table 370, and an edge of the intermediate substrate layer 340 are exposed to cut into the wellbore during drilling.

According to certain exemplary embodiments, at least one blade 1310 includes a first set 1360 of PDC disc cutters 300 and a second set 1362 of PDC disc cutters 300. The first set 1360 of PDC disc cutters 300 is substantially similar to the second set 1362 of PDC disc cutters 300, except that the second set 1362 is positioned differently than the first set 1360. The first set 1360 is position in a row near a leading edge 1361 of the blade 1310, while the second set 1362 is substantially positioned in a row behind the first set 1360, or near a trailing edge 1363 of the blade 1310, thus becoming back-up cutters in certain exemplary embodiments. At least one of the PDC disc cutters 300 in the second set 1362 is positioned offset from the PDC disc cutters 300 of the first set 1360. In certain exemplary embodiments, one or more of the PDC disc cutters 300 of the second set 1362 is positioned at the same exposure level, i.e. inserted at the same depth in the blade 1310, as at least one of the PDC disc cutters 300 of the first set 1360. In certain exemplary embodiments, one or more of the PDC disc cutters 300 of the second set 1362 is positioned at an under-exposure level, i.e. inserted at a deeper depth in the blade 1310, than at least one of the PDC disc cutters 300 of the first set 1360.

Figure 14A:
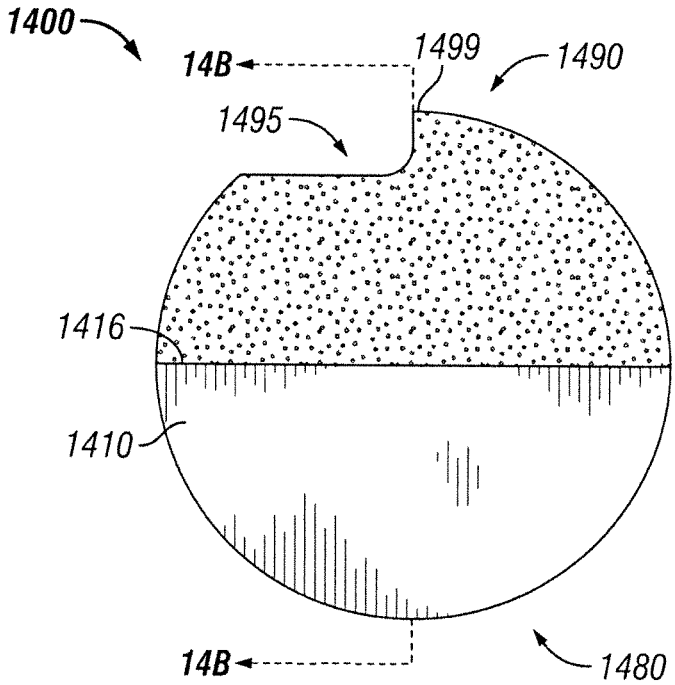
FIG. 14A is a front view of a PDC disc cutter in accordance with an exemplary embodiment of the present invention.
Figure 14B:
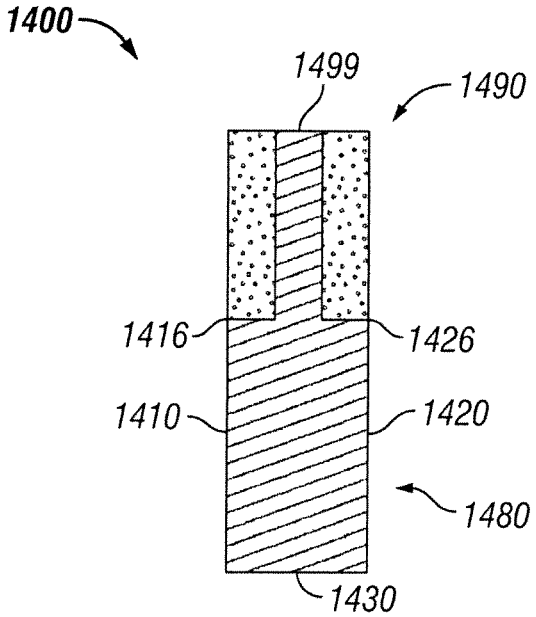
FIG. 14B is a side cross-sectional view of the PDC disc cutter of FIG. 14A in accordance with an exemplary embodiment of the present invention.

FIG. 14A is a front view of a PDC disc cutter 1400 in accordance with an exemplary embodiment of the present invention. FIG. 14B is a side cross-sectional view of the PDC disc cutter 1400. Referring to FIGS. 14A and 14B, the PDC disc cutter 1400 is substantially cylindrically shaped, or substantially disc-shaped, and includes a first surface 1410, a second surface 1420, and a sidewall 1430 extending from the first surface 1410 to the second surface 1420. The PDC disc cutter 1400 also includes an upper portion 1490 and a lower portion 1480 that is similar to the upper portion 390 (FIG. 3B) and the lower portion 380 (FIG. 3B). PDC disc cutter 1400 is similar to PDC disc cutter 300 (FIGS. 3A and 3B), except that a portion of the upper portion 1490 is removed to form a relief area 1495 and a tip 1499, or apex, that is adjacent to the relief area 1495. According to some exemplary embodiments, the relief area 1495 is formed using wire electrical discharge machining (EDM) techniques. Alternatively, the relief area 1495 is formed using other known techniques. The wire EDM technique makes cuts in generally two directions, which can be a substantially right angle in some exemplary embodiments. However, the cuts can be made in a single angular direction or in various multi-directions that extend from the tip 1499 to another portion of the upper portion 1490. According to some exemplary embodiments, the tip 1499 is positioned substantially equidistantly from each end of either a first interface 1416 of the first surface 1410 or a second interface 1426 of the second surface 1420. However, the positioning of the tip 1499 in the upper portion 1490 is different in other exemplary embodiments. PDC disc cutter 1400 is capable of shearing soft rock formations, such as shale, when coupled to a down hole tool and used in drilling processes. However, when the downhole tool enters harder rock formations, the same PDC disc cutters 1400 on the down hole tool can have additional load applied onto them so that they provide a spalling mechanism to cut the formation. Although PDC disc cutter 1400 is a modification of PDC disc cutter 300 (FIG. 3A), a similar modification is performed with respect to PDC disc cutter 600 (FIG. 6A) in other exemplary embodiments.

The PDC disc cutter 1400 is mounted to a bit for drilling subterranean formations. Additionally, in certain exemplary embodiments, these PDC disc cutters 1400, which are not fully cylindrical disc bits, and other fully cylindrical PDC disc cutters 300, 400, 600, 900, 1000, 1100 are both coupled to a bit, either of the same blade, on different blades, in the same area of the bit, or in different areas of the bit. The PDC disc cutters 1400 are coupled to the bit such that these PDC disc cutters 1400 are overexposed, underexposed, or equally exposed with respect to the other fully cylindrical PDC disc cutters 300, 400, 600, 900, 1000, 1100.

PDC disc cutters of this invention allow for the advantageous high point loading and slicing/plowing cutting action of traditional disc bits while overcoming the traditional early failure mechanisms (axle wear/breakage and premature cutter wear) of prior art disc bits. The fixed cutter disc cutter designs accomplish this by dispensing with disc rotation. The rotating designs benefit from large axle holes (and accompanying large wear and breakage resistant axles) made possible by the slow wearing properties of the PDC enhanced discs. Additionally these bits drill with low torque making them ideal for slim hole, coiled tubing drilling, and steerable motor applications where high torque bits can effect tool face orientation or bottom hole assembly integrity. As the fixed cutter PDC disc cutter bits wear their torque signature stays low because their "wear flat" is oriented generally in the circumferential direction rather than in the radial direction as on tradition right circular cylinder PDC shear bits. In addition, in some of the exemplary embodiments, as the cutters wear, the tungsten carbide substrate core of the cutters wears slightly faster than the PDC diamond leaving aggressive knife edges of diamond to attack the formation.

The PDC disc cutters described in the exemplary embodiments provide numerous advantages. These disc cutters are able to withstand higher thrust forces, which lead to increase penetration into the earthen formation that is being drilled. The cutting action of these bits are comparable to the cutting action of traditional surface set natural diamond bits that cut via plowing/grinding/spalling action. The disc bits that use these PDC disc cutters, described herein, are therefore also applicable in hard to very hard formations that currently cannot be economically drilled with existing PDC shear bits. Several versions of the PDC disc cutter, when deployed on a bit face, incorporate a gradual and effective "depth of cut" control mechanism. Spikes in weigh-on-bit are absorbed gradually and smoothly by the curvature and increased surface area of the cutting discs as they are pushed deeper into the formation by the weight spikes.

According to certain exemplary embodiments, the disc cutters can be built in various diameters and one or more than one diameter of rotating, or non-rotating disc can be used on a particular bit's cutting face. Disc cutters can also be augmented by traditional shear cutting PDC cutters, especially on the gage section of the bit. Additionally, a combination of PDC disc cutters and shear cutters can be deployed in advantageous patterns across a bit face to better handle transitional drilling, and passage from softer to harder formation zones.

Further, all design variations known to be applicable to shear cutter bit designs also are applicable to the disc cutter bit designs. These design variations include, but are not limited to, having redundant cutters, serrated cutting patterns, mixed cutter sizes, overlapping cutters, tracking cutters, back-up cutters, shock studs, depth of cut control mechanisms, fluid control and distribution layouts, alternating siderakes, increasing siderakes, decreasing siderakes, varied cutter tip geometries, variations in hydraulic design, variations in nozzle layout, variations in fluid course and cooling channel layout and distribution, variations in diamond thickness, variations in diamond grain size or volume, variations in cobalt content in the diamond, cutter leaching, cutter polishing, variations in diamond to carbide interface, variations in pocket configurations, variations in mounting methods that include brazing, gluing, clamping, and press fitting, bit force balancing optimization, bit work balancing optimization, bits with bi-center designs, the use of disc cutters on hole openers, reamers, expandable reamers, core bits, hybrid bits, casing drilling bits, and others. Although these disc cutters cannot be "backraked" in the traditional sense of a shear cutter, they can be tilted relative to the profile of the bit. The disc cutters, therefore, can be deployed with mixed positive and negative tilts, or increasing or decreasing tilts, or other variations of the tilt.

Although each exemplary embodiment has been described in detail, it is to be construed that any features and modifications that are applicable to one embodiment, whether being a rotatable disc cutter or a fixed disc cutter, are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A disc cutter, comprising:

a first surface comprising a first upper portion, a first lower portion, and a first interface positioned between the first upper portion and the first lower portion;

a second surface comprising a second upper portion, a second lower portion, and a second interface positioned between the second upper portion and the second lower portion;

a sidewall extending from the perimeter of the first surface to the perimeter of the second surface;

an overall lower portion comprising the first lower portion and the second lower portion and extending therebetween;

an overall upper portion comprising the first upper portion and the second upper portion and extending therebetween;

an intermediate substrate layer extending outwardly from at least a portion of the overall lower portion to a distal end positioned within the overall upper portion, the intermediate substrate layer comprising a first side edge extending from a portion of the overall lower portion to the distal end and facing the first surface and a second side edge extending from a portion of the overall lower portion to the distal end and facing the second surface;

a first cutting table positioned in the overall upper portion and extending from the first side edge to the first upper portion; and a second cutting table positioned in the overall upper portion and extending from the second side edge to the second upper portion.

2. The disc cutter of claim 1, wherein distal end forms a portion of the sidewall in the upper portion.

3. The disc cutter of claim 1, wherein the overall lower portion and the intermediate substrate layer are fabricated using a substrate material.

4. The disc cutter of claim 3, wherein the substrate material comprises a tungsten carbide.

5. The disc cutter of claim 1, wherein at least one of the first cutting table and the second cutting table is fabricated using a material selected from the group consisting of polycrystalline diamond, synthetic diamond grit, natural diamond grit, and cubic boron nitride.

6. The disc cutter of claim 1, wherein the intermediate substrate layer is half-disc shaped.

7. The disc cutter of claim 1, wherein the first side edge extends from the overall lower portion at a first transition area and the second side edge extends from the overall lower portion at a second transition area, at least one of the first transition area and the second transition area forming about a 90° angle.

8. The disc cutter of claim 1, wherein the first side edge extends from the overall lower portion at a first transition area and the second side edge extends from the overall lower portion at a second transition area, at least one of the first transition area and the second transition area being concave-shaped.

9. The disc cutter of claim 1, wherein the first side edge extends into the overall upper portion from the first interface and wherein the second side edge extends into the overall upper portion from the second interface.

10. The disc cutter of claim 1, wherein the first interface is a diameter of the first surface and the second interface is a diameter of the second surface.

11. A downhole tool, comprising:

at least one blade comprising one or more disc receiving cavities formed therein;

one or more disc cutters, each disc cutter coupled within a corresponding disc receiving cavity, each disc cutter comprising:

an upper disc portion, at least the perimeter of the upper disc portion being fabricated using a material selected from the group consisting of polycrystalline diamond, synthetic diamond grit, natural diamond grit, cubic boron nitride, and impregnated diamond layer;

a lower disc portion fabricated using a substrate material;

an interface positioned between the upper disc portion and the lower disc portion; and an intermediate substrate layer extending outwardly from at least a portion of the lower disc portion to a distal end positioned within the upper disc portion, the intermediate substrate layer comprising a first side edge extending from a portion of the lower disc portion to the distal end and a second side edge extending from a portion of the upper disc portion to the distal end wherein at least a portion of the upper disc portion is exposed beyond the cavity, and wherein at least a portion of the lower disc portion is inserted into the cavity.

12. The downhole tool of claim 11, wherein the upper disc portion is substantially half-moon shaped and wherein the lower disc portion is substantially half-moon shaped.

13. The downhole tool of claim 11, wherein at least one disc cutter is inserted into the blade at a different depth than another disc cutter.

14. The downhole tool of claim 11, wherein a first set of disc cutters is coupled to the blade near a leading edge of the blade and a second set of disc cutters is coupled to the blade behind the first set of disc cutters.

15. The downhole tool of claim 14, wherein one or more cutters of the second set of disc cutters is positioned offset with respect to the positioning of adjacently positioned disc cutters of the first set.

16. The downhole tool of claim 11, further comprising a matrix pocket coupled around a portion of one or more cavities at the surface of the blade, the matrix pocket extending outwardly from the surface of the blade and surrounding a portion of the disc cutter that is closer to a trailing edge of the blade.

17. The downhole tool of claim 11, wherein the one or more disc receiving cavities are formed in a plurality of rows, each disc cutter being coupled to a respective cavity.

18. The downhole tool of claim 1, further comprising one or more shear cutters, the shear cutters being coupled to the blade, the disc cutters and the shear cutters being positioned in an alternating pattern along at least one blade.

19. The downhole tool of claim 11, wherein each blade comprises:

a bit center region comprising one or more shear cutters;

a nose region positioned adjacent the bit center region; and a shoulder region positioned adjacent the nose region, wherein at least one of the nose region and the shoulder region comprises one or more disc cutters.

20. The downhole tool of claim 11, wherein each blade comprises:

a gage region comprising one or more shear cutters;

a shoulder region positioned adjacent the gage region; and a nose region positioned adjacent the shoulder region, wherein at least one of the nose region and the shoulder region comprises one or more disc cutters.

21. The downhole tool of claim 11, wherein the substrate material is fabricated using a group consisting of tungsten carbide with a cobalt binder, tungsten carbide with a nickel binder, tungsten carbide with a molybdenum binder, molybdenum carbide, and titanium carbide.

22. The downhole tool of claim 11, wherein at least one disc cutter is oriented in a sideraked position.

23. The downhole tool of claim 11, wherein at least one disc cutter is oriented non-perpendicularly with respect to a surface of the blade.

24. A downhole tool, comprising:

a plurality of concentric platforms forming a stair-stepped frusto-conical profile shape, each concentric platform comprising one or more disc receiving cavities formed therein;

one or more disc cutters, each disc cutter coupled within a corresponding disc receiving cavity on one or more of the concentric platforms, each disc cutter comprising:

an upper disc portion, at least the perimeter of the upper disc portion being fabricated using a material selected from the group consisting of polycrystalline diamond, synthetic diamond grit, natural diamond grit, cubic boron nitride, and impregnated diamond layer;

a lower disc portion fabricated using a substrate material;

an interface positioned between the upper disc portion and the lower disc portion wherein at least a portion of the upper disc portion is exposed beyond the cavity, and wherein at least a portion of the lower disc portion is inserted into the cavity.

25. The downhole tool of claim 24, wherein the cavities are formed one or more circular patterns along one or more of the concentric platforms.

26. A disc cutter, comprising:

a substrate material comprising an outer periphery area, the outer periphery area being substantially circumferential; and a superhard material layer bonded to at least a portion of the outer periphery area.

27. The disc cutter of claim 26, wherein the disc cutter is deployed on a drill bit for drilling an earthen formation.

28. The disc cutter of claim 26, wherein the thickness of the superhard material layer ranges from about 0.010 inches to about 0.125 inches.

29. The disc cutter of claim 26, wherein the superhard material layer comprises a diamond layer, the diamond layer comprising a higher density of diamond at an outer periphery of the diamond layer and a lower density of diamond at an inner periphery of the diamond layer, the inner periphery of the diamond layer being adjacent to the outer periphery area of the substrate material.

30. The disc cutter of claim 29, wherein the density of diamond progressively decreases from the outer periphery of the diamond layer to the inner periphery of the diamond layer.

31. The disc cutter of claim 26, wherein the substrate material is fabricated using one of tungsten carbide with a cobalt binder, tungsten carbide with a nickel binder, tungsten carbide with a molybdenum binder, molybdenum carbide, or titanium carbide.

* * * * *